US008183776B2

(12) United States Patent
Oh et al.

(10) Patent No.: US 8,183,776 B2
(45) Date of Patent: May 22, 2012

(54) PLASMA DISPLAY PANEL HAVING A SEAL LAYER THAT CONTAINS BEADS

(75) Inventors: Jaeyoung Oh, Gumi (KR); Woogon Jeon, Gumi (KR); Heerak Kim, Gumi (KR); Daeil Han, Gumi (KR)

(73) Assignee: LG Electronics Inc., Seoul (KR)

( * ) Notice: Subject to any disclaimer, the term of this patent is extended or adjusted under 35 U.S.C. 154(b) by 301 days.

(21) Appl. No.: 11/966,581

(22) Filed: Dec. 28, 2007

(65) Prior Publication Data

US 2008/0284334 A1 Nov. 20, 2008

(30) Foreign Application Priority Data

May 18, 2007 (KR) ..... 10-2007-0048604
Jul. 26, 2007 (KR) ..... 10-2007-0075235
Jul. 26, 2007 (KR) ..... 10-2007-0075248

(51) Int. Cl.
*H01J 17/49* (2012.01)

(52) U.S. Cl. ..... 313/587; 313/585

(58) Field of Classification Search ..... 313/581–587, 313/512; 445/25
See application file for complete search history.

(56) References Cited

U.S. PATENT DOCUMENTS 6,242,859 B1 * 6/2001 Betsui et al. ..... 313/584
7,019,461 B2 * 3/2006 Harada ..... 313/586
7,977,881 B2 * 7/2011 Oh ..... 313/582
8,080,940 B2 * 12/2011 Oh et al. ..... 313/587
2003/0015963 A1 1/2003 Tanaka ..... 313/582
2003/0137245 A1 7/2003 Nakatani et al. ..... 313/582
2006/0001373 A1 1/2006 Nonomura et al. ..... 313/582

FOREIGN PATENT DOCUMENTS

JP 2001-236896 A 8/2001
JP 2003-297253 A 10/2003
JP 2006-310050 A 11/2006
KR 10-2006-0045275 A 5/2006
WO WO 00/31580 6/2000

OTHER PUBLICATIONS

European Search Report dated Jun. 9, 2009.
PCT International Search Report dated Apr. 23, 2008.
Supplementary Partial European Search Report issued in EP Application No. 07 86 0828 dated Jul. 13, 2009.
International Search Report issued in PCT/KR2007/007053 dated Apr. 23, 2008.
U.S. Office Action issued in U.S. Appl. No. 11/966,491 dated Jan. 19, 2011.

* cited by examiner

*Primary Examiner* — Toan Ton
*Assistant Examiner* — Britt D Hanley
(74) *Attorney, Agent, or Firm* — KED & Associates, LLP

(57) ABSTRACT

A plasma display panel is provided. The plasma display panel includes a front substrate, a rear substrate positioned opposite the front substrate, a barrier rib positioned between the front substrate and the rear substrate, and a seal layer positioned between the front substrate and the rear substrate. The seal layer includes a bead. An angle between the front substrate and the rear substrate in a disposition area of the seal layer ranges from 0.2° to 1.0°.

5 Claims, 24 Drawing Sheets

FIG. 8A

| θ(°) | Noise | Crosstalk |
|---|---|---|
| 0.1 | × | ◎ |
| 0.15 | × | ◎ |
| 0.2 | ○ | ◎ |
| 0.25 | ○ | ◎ |
| 0.3 | ◎ | ◎ |
| 0.4 | ◎ | ◎ |
| 0.53 | ◎ | ◎ |
| 0.59 | ◎ | ◎ |
| 0.64 | ◎ | ◎ |
| 0.72 | ◎ | ○ |
| 0.81 | ◎ | ○ |
| 0.95 | ◎ | ○ |
| 1.0 | ◎ | ○ |
| 1.2 | ◎ | × |
| 1.3 | ◎ | × |

| R/h | Noise | Crosstalk |
|---|---|---|
| 0.9 | X | ○ |
| 0.95 | X | ◎ |
| 1.01 | ○ | ◎ |
| 1.04 | ◎ | ◎ |
| 1.2 | ◎ | ◎ |
| 1.3 | ◎ | ◎ |
| 1.37 | ◎ | ◎ |
| 1.45 | ◎ | ○ |
| 1.7 | ◎ | X |
| 1.8 | ◎ | X |

PLASMA DISPLAY PANEL HAVING A SEAL LAYER THAT CONTAINS BEADS

This application claims the benefit of Korean Patent Application Nos. 10-2007-0048604 filed on May 18, 2007, 10-2007-0075248 filed on Jul. 26, 2007 and 10-2007-0075235 filed on Jul. 26, 2007 which are hereby incorporated by reference.

BACKGROUND OF THE DISCLOSURE

1. Field of the Disclosure

This document relates to a plasma display panel.

2. Description of the Related Art

A plasma display panel includes a phosphor layer inside discharge cells partitioned by barrier ribs and a plurality of electrodes.

When driving signals are applied to the electrodes of the plasma display panel, a discharge occurs inside the discharge cells. In other words, when the plasma display panel is discharged by applying the driving signals to the discharge cells, a discharge gas filled in the discharge cells generates vacuum ultraviolet rays, which thereby cause phosphors positioned between the barrier ribs to emit light, thus producing visible light. An image is displayed on the screen of the plasma display panel due to the visible light.

SUMMARY OF THE DISCLOSURE

In one aspect, a plasma display panel comprises a front substrate, a rear substrate positioned to be opposite to the front substrate, a barrier rib positioned between the front substrate and the rear substrate, and a seal layer positioned between the front substrate and the rear substrate, the seal layer including a bead, wherein an angle between the front substrate and the front substrate in a disposition area of the seal layer ranges from 0.2° to 1.0°.

In another aspect, a plasma display panel comprises a front substrate on which an upper dielectric layer is positioned, a rear substrate on which a lower dielectric layer is positioned, the rear substrate being opposite to the front substrate, a barrier rib positioned between the front substrate and the rear substrate, and a seal layer positioned between the front substrate and the rear substrate, the seal layer including a bead, a first portion positioned in an overlap area of the upper dielectric layer and the lower dielectric layer, and a second portion positioned in an area where at least one of the upper dielectric layer or the lower dielectric layer is omitted, a section length of the first portion being longer than a section length of the second portion.

In yet another aspect, a plasma display panel comprises a front substrate, a rear substrate positioned to be opposite to the front substrate, a barrier rib positioned between the front substrate and the rear substrate, and a seal layer positioned between the front substrate and the rear substrate, the seal layer including a bead, wherein an interval between the front substrate and the rear substrate in an area inside the plasma display panel based on the seal layer is smaller than an interval between the front substrate and the rear substrate in an area outside the plasma display panel.

BRIEF DESCRIPTION OF THE DRAWINGS

The accompanying drawings, which are included to provide a further understanding of the invention and are incorporated on and constitute a part of this specification, illustrate embodiments of the invention and together with the description serve to explain the principles of the invention. In the drawings:

FIGS. 8A to 8C are diagrams for explaining an angle between a front substrate and a rear substrate;

DETAILED DESCRIPTION OF EMBODIMENTS

Reference will now be made in detail embodiments of the invention examples of which are illustrated in the accompanying drawings.

Figure 1:
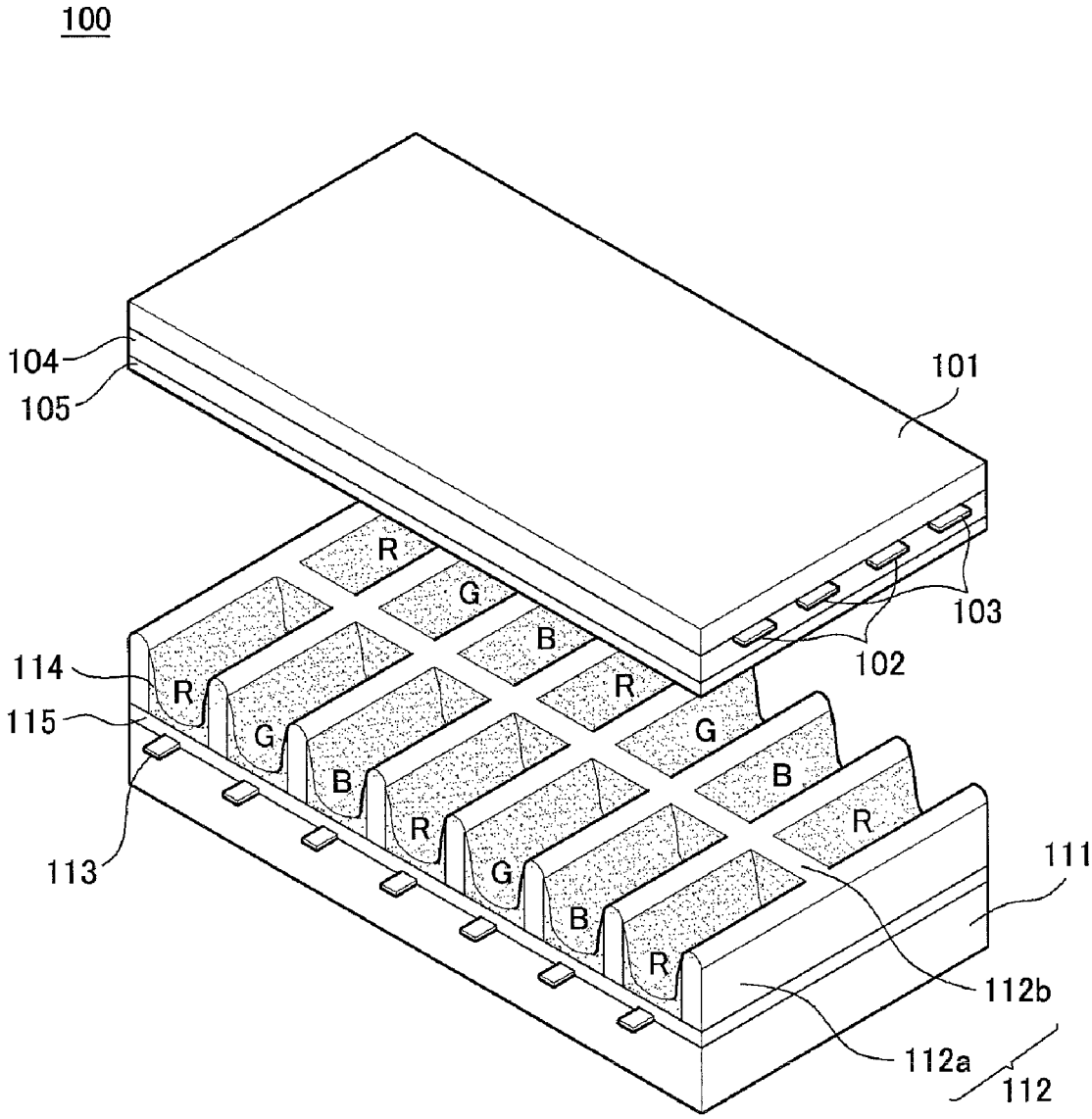
FIG. 1 illustrates a structure of a plasma display panel according to an exemplary embodiment.

FIG. 1 illustrates a structure of a plasma display panel according to an exemplary embodiment.

As shown in FIG. 1, a plasma display panel 100 according to an exemplary embodiment includes a front substrate 101, on which a scan electrode 102 and a sustain electrode 103 are positioned parallel to each other, and a rear substrate 111 on which an address electrode 113 is positioned to intersect the scan electrode 102 and the sustain electrode 103. The front substrate 101 and the rear substrate 111 coalesce with each other by a seal layer (not show) to be opposite to each other.

An upper dielectric layer 104 is positioned on the scan electrode 102 and the sustain electrode 103 to provide electrical insulation between the scan electrode 102 and the sustain electrode 103.

A protective layer 105 is positioned on the upper dielectric layer 104 to facilitate discharge conditions. The protective layer 105 may include a material having a high secondary electron emission coefficient, for example, magnesium oxide (MgO).

A lower dielectric layer 115 is positioned on the address electrode 113 to provide electrical insulation of the address electrodes 113.

Barrier ribs 112 of a stripe type, a well type, a delta type, a honeycomb type, and the like, are positioned on the lower dielectric layer 115 to partition discharge spaces (i.e., discharge cells). A red (R) discharge cell, a green (G) discharge cell, and a blue (B) discharge cell, and the like, may be positioned between the front substrate 101 and the rear substrate 111. In addition to the red (R), green (G), and blue (B) discharge cells, a white (W) discharge cell or a yellow (Y) discharge cell may be further positioned.

Each discharge cell partitioned by the barrier ribs 112 is filled with a discharge gas including xenon (Xe), neon (Ne), and the like.

A phosphor layer 114 is positioned inside the discharge cells to emit visible light for an image display during an address discharge. For instance, first, second and third phosphor layer respectively emitting red (R), blue (B) and green (G) light may be positioned inside the discharge cells. In addition to the red (R), green (G) and blue (B) light, a phosphor layer emitting white or yellow light may be further positioned.

A thickness of at least one of the phosphor layers 114 formed inside the red (R), green (G) and blue (B) discharge cells may be different from thicknesses of the other phosphor layers. For instance, thicknesses of the second and third phosphor layers inside the blue (B) and green (G) discharge cells may be larger than a thickness of the first phosphor layer inside the red (R) discharge cell. The thickness of the second phosphor layer may be substantially equal or different from the thickness of the third phosphor layer.

Widths of the red (R), green (G), and blue (B) discharge cells may be substantially equal to one another. Further, a width of at least one of the red (R), green (G), or blue (B) discharge cells may be different from widths of the other discharge cells. For instance, a width of the red (R) discharge cell may be the smallest, and widths of the green (G) and blue (B) discharge cells may be larger than the width of the red (R) discharge cell. The width of the green (G) discharge cell may be substantially equal or different from the width of the blue (B) discharge cell. Hence, a color temperature of an image displayed on the plasma display panel can be improved.

The plasma display panel 100 may have various forms of barrier rib structures as well as a structure of the barrier rib 112 shown in FIG. 1. For instance, the barrier rib 112 includes a first barrier rib 112*b* and a second barrier rib 112*a*. The barrier rib 112 may have a differential type barrier rib structure in which heights of the first and second barrier ribs 112*b* and 112*a* are different from each other.

In the differential type barrier rib structure, a height of the first barrier rib 112*b* may be smaller than a height of the second barrier rib 112*a*.

While FIG. 1 has been illustrated and described the case where the red (R), green (G) and blue (B) discharge cells are arranged on the same line, the red (R), green (G) and blue (B) discharge cells may be arranged in a different pattern. For instance, a delta type arrangement in which the red (R), green (G), and blue (B) discharge cells are arranged in a triangle shape may be applicable. Further, the discharge cells may have a variety of polygonal shapes such as pentagonal and hexagonal shapes as well as a rectangular shape.

While FIG. 1 has illustrated and described the case where the barrier rib 112 is formed on the rear substrate 111, the barrier rib 112 may be formed on at least one of the front substrate 101 or the rear substrate 111.

In FIG. 1, the upper dielectric layer 104 and the lower dielectric layer 115 each have a single-layered structure. However, at least one of the upper dielectric layer 104 or the lower dielectric layer 115 may have a multi-layered structure.

While the address electrode 113 positioned on the rear substrate 111 may have a substantially constant width or thickness, a width or thickness of the address electrode 113 inside the discharge cell may be different from a width or thickness of the address electrode 113 outside the discharge cell. For instance, a width or thickness of the address electrode 113 inside the discharge cell may be larger than a width or thickness of the address electrode 113 outside the discharge cell.

Figure 2:
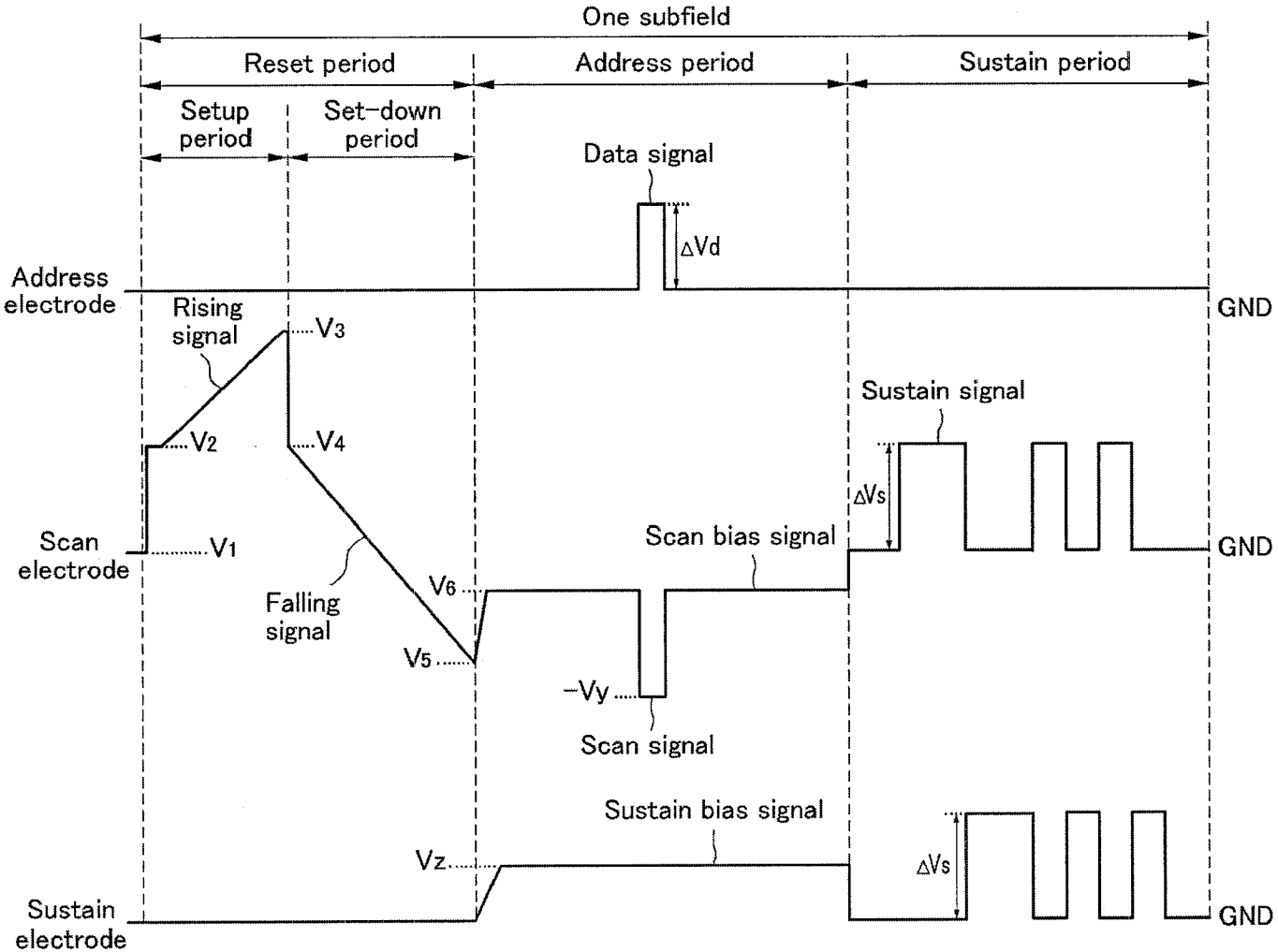
FIG. 2 illustrates an example of an operation of the plasma display panel according to the exemplary embodiment.

FIG. 2 illustrates an example of an operation of the plasma display panel according to the exemplary embodiment. The exemplary embodiment is not limited to FIG. 2, and the plasma display can be operated in various manners.

As shown in FIG. 2, during a reset period for initialization, a reset signal is supplied to the scan electrode. The reset signal includes a rising signal and a falling signal. The reset period is further divided into a setup period and a set-down period.

The rising signal is supplied to the scan electrode during the setup period, thereby generating a weak dark discharge (i.e., a setup discharge) inside the discharge cell during the setup period. Hence, a proper amount of wall charges are accumulated inside the discharge cell.

The falling signal is supplied to the scan electrode during the set-down period, thereby generating a weak erase discharge (i.e., a set-down discharge) inside the discharge cell. Hence, the remaining wall charges are uniform inside the discharge cells to the extent that an address discharge occurs stably.

During an address period following the reset period, a scan bias signal, which is substantially maintained at a sixth voltage V6 higher than a lowest voltage V5 of the falling signal, is supplied to the scan electrode.

A scan signal falling from the scan bias signal is supplied to the scan electrode.

A width of a scan signal supplied during an address period of at least one subfield may be different from widths of scan signals supplied during address periods of the other subfields. A width of a scan signal in a subfield may be larger than a width of a scan signal in a next subfield in time order. For instance, a width of the scan signal may be gradually reduced in the order of 2.6 μs, 2.3 μs, 2.1 μs, 1.9 μs, etc., or may be reduced in the order of 2.6 μS, 2.3 μs, 2.3 μs, 2.1 μs, . . . , 1.9 μs, 1.9 μs, etc, in the successively arranged subfields.

As above, when the scan signal is supplied to the scan electrode, a data signal corresponding to the scan signal is supplied to the address electrode.

As the voltage difference between the scan signal and the data signal is added to the wall voltage produced during the reset period, the address discharge occurs inside the discharge cell to which the data signal is supplied.

A sustain bias signal is supplied to the sustain electrode during the address period so as to prevent the generation of unstable address discharge by interference of the sustain electrode.

The sustain bias signal is substantially maintained at a sustain bias voltage Vz. The sustain bias voltage Vz is lower than a voltage Vs of a sustain signal and is higher than a ground level voltage GND.

During a sustain period following the address period, the sustain signal may be supplied to at least one of the scan electrode or the sustain electrode. For instance, the sustain signal is alternately supplied to the scan electrode and the sustain electrode.

As the wall voltage inside the discharge cell selected by performing the address discharge is added to the sustain voltage Vs of the sustain signal, every time the sustain signal is supplied, a sustain discharge, i.e., a display discharge occurs between the scan electrode and the sustain electrode.

A plurality of sustain signals are supplied during a sustain period of at least one subfield, and a width of at least one of the plurality of sustain signals may be different from widths of the other sustain signals. For instance, a width of a first supplied sustain signal among the plurality of sustain signals may be larger than widths of the other sustain signals. Hence, a sustain discharge can more stably occur.

Figure 3A:
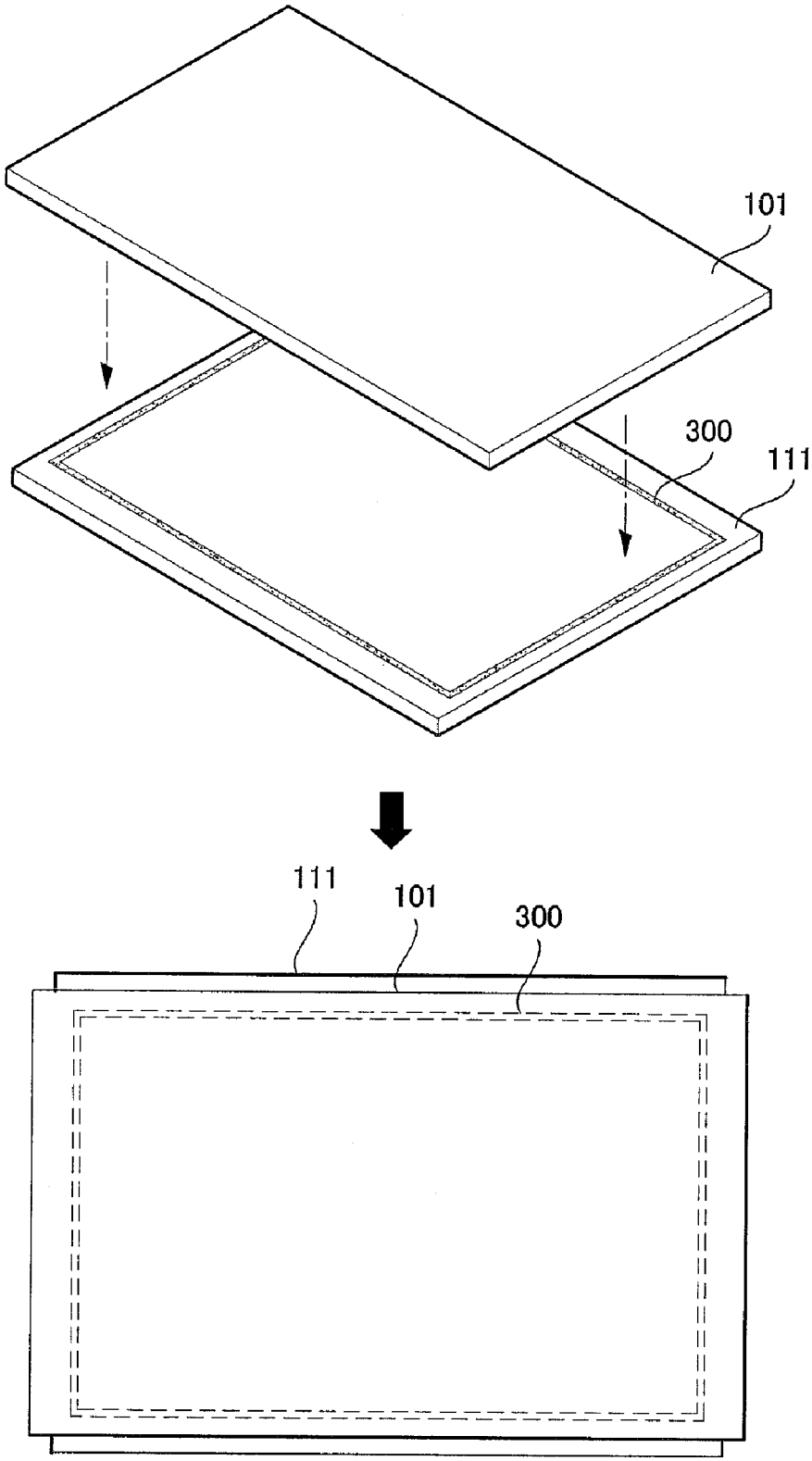
FIGS. 3A to 3C illustrate an example of a method of manufacturing the plasma display panel.
Figure 3B:
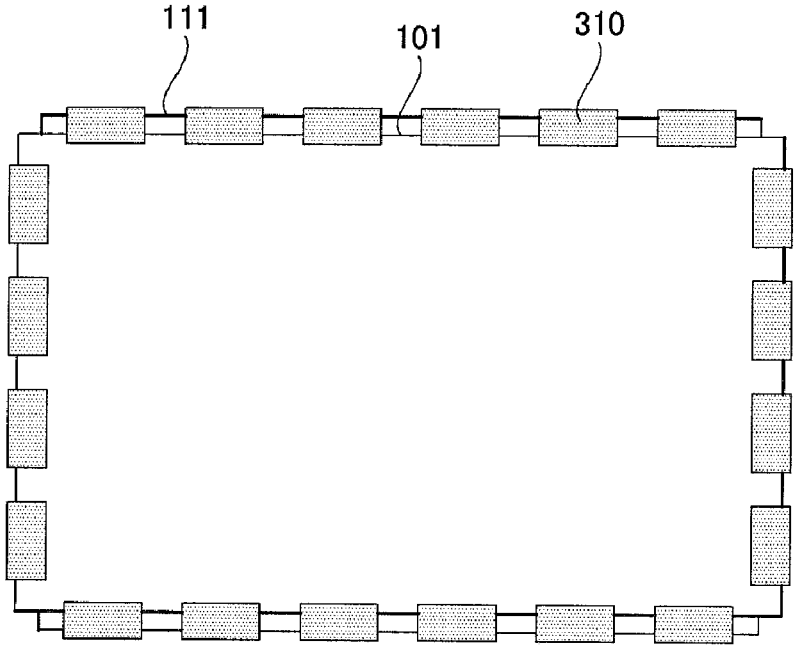
Figure 3C:
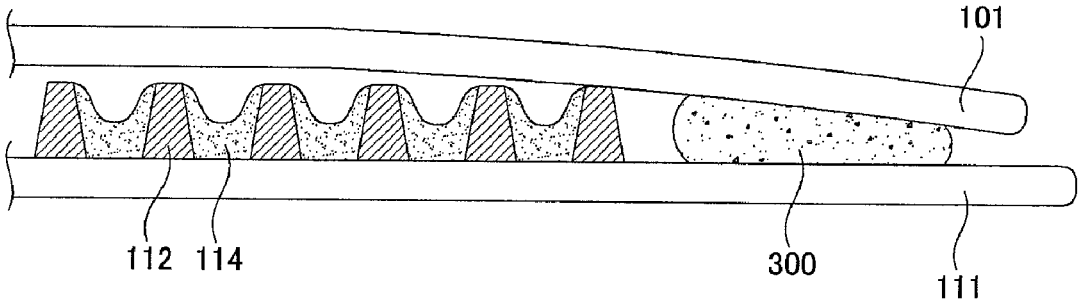

FIGS. 3A to 3C illustrate an example of a method of manufacturing the plasma display panel.

As shown in FIG. 3A, a seal layer 300 is formed at an edge of at least one of the front substrate 101 or the rear substrate 111, and the front substrate 101 and the rear substrate 111 coalesce with each other using the seal layer 300. For instance, the seal layer 300 is formed in a dummy area of the rear substrate 111, and it is possible that the front substrate 101 and the rear substrate 111 coalesce with each other by applying a pressure to the front substrate 101 and the rear substrate 111 to complete a coalescing structure.

As shown in FIG. 3B, a fixing device 310 such as a clip is disposed at an edge of the coalescing structure. The fixing device 310 fix the coalescing structure so that the front substrate 101 and the rear substrate 111 are aligned with each other until the seal layer 300 is hardened.

While the fixing device 310 is used to align the front substrate 101 with the rear substrate 111, the fixing device 310 may apply a pressure to the edge of the coalescing structure to excessively compress the seal layer 300 as shown in FIG. 3C. As a result, an interval between the front substrate 101 and the rear substrate 111 may be not uniform. The front substrate 101 may collide with the barrier rib during the drive of the panel due to the nonuniform interval, and thus a noise may excessively occur. It is possible that the seal layer 300 includes beads so as to reduce the noise.

Figure 4:
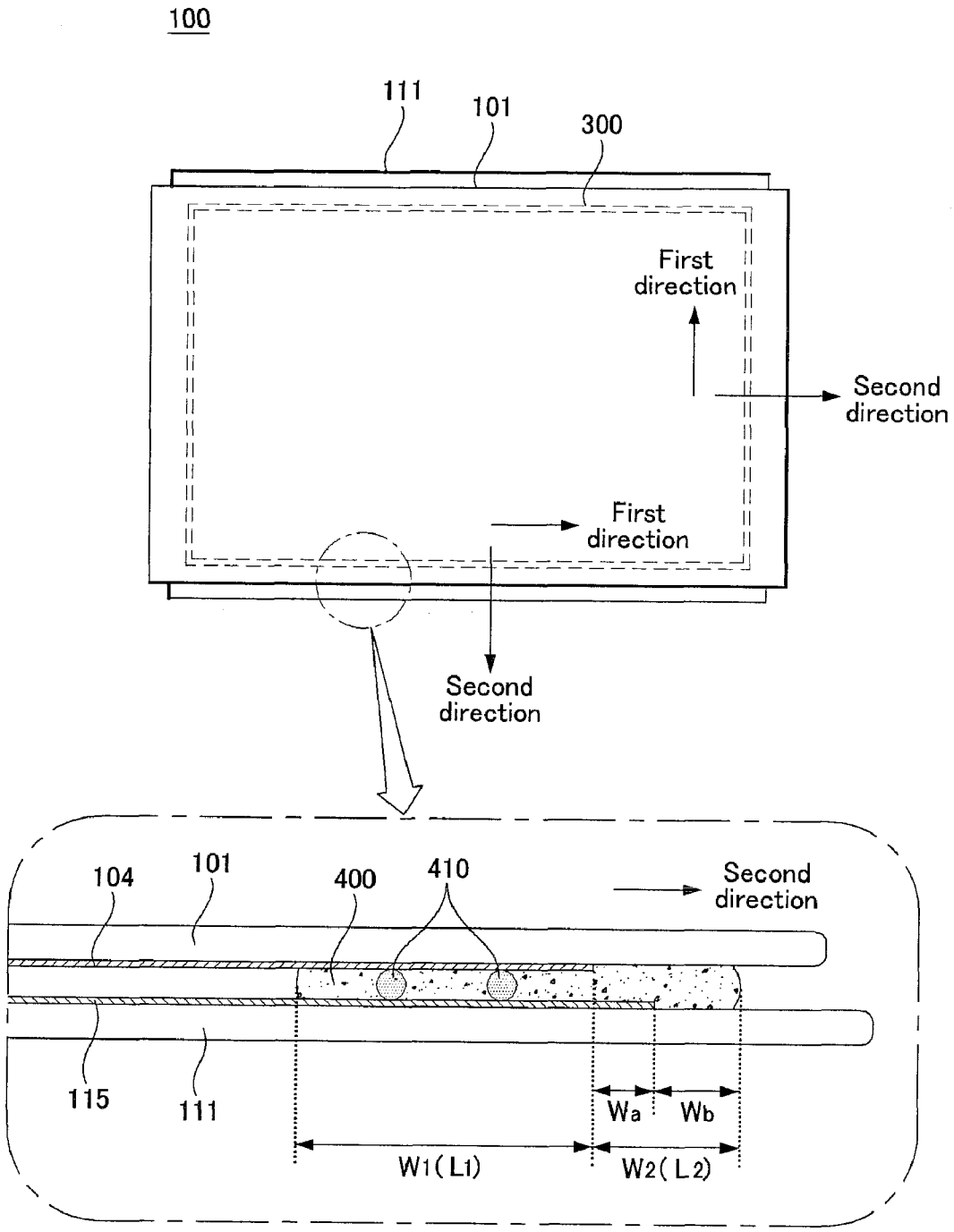
FIG. 4 is a diagram for explaining a seal layer.

FIG. 4 is a diagram for explaining a seal layer.

As shown in FIG. 4, a seal layer 400 of the plasma display panel 100 includes beads 410.

The bead 410 can support the front substrate 101 and the rear substrate 111, and prevent the seal layer 400 from being excessively compressed. Hence, a thickness of the seal layer 400 may be kept constant. Further, the bead 410 can prevent the collision of the front substrate 101 and the barrier rib during the drive of the panel, thereby reducing the generation of noise.

An example of a method of manufacturing the seal layer 400 will be described below.

First, a seal material, a solvent, a binder and the bead 410 are mixed to form a seal paste having the fluidity.

Afterwards, the seal paste is coated on a dummy area of at least one of the front substrate 101 or the rear substrate 111 to attach the front substrate 101 to the rear substrate 111.

A process for firing the seal paste is performed in a firing furnace to melt the seal material of the seal paste coated between the front substrate 101 and the rear substrate 111 and to burn the binder and the solvent. Hence, the seal layer 400 is formed.

If the bead 410 mixed with the seal material is melted in the firing process of the seal paste, it is difficult to properly maintain the interval between the front substrate 101 and the rear substrate 111. Accordingly, it may be preferable not to melt the bead 410 in the firing process. A melting point of the bead 410 may be higher than a melting point of the seal material. The melting point of the bead 410 may be equal to or higher 500° C.

A material of the bead 410 is not particularly limited except that the bead 410 is not melted in the firing process of the seal paste. The material of the bead 410 may be metal, plastic, glass, silicon, and the like.

An overlap area of the upper dielectric layer 104 and the lower dielectric layer 115 between the front substrate 101 and the rear substrate 111 is referred to as a first area, and an area where at least one of the upper dielectric layer 104 or the lower dielectric layer 115 is omitted is referred to as a second area.

The seal layer 400 may include a first portion W1 positioned in the first area and a second portion W2 positioned in the second area. The first portion W1 may overlap the upper dielectric layer 104 and the lower dielectric layer 115, and the second portion W2 may overlap one of the upper dielectric layer 104 or the lower dielectric layer 115.

Since a surface area of the seal layer 400 including the first portion W1 and the second portion W2 is larger than a surface area of the seal layer 400 positioned in only the first area and a surface area of the seal layer 400 positioned in only the second area, an adhesive strength between the front substrate 101 and the rear substrate 111 can be improved.

In FIG. 4, the second portion W2 may overlap the lower dielectric layer 115. The second portion W2 may include a portion Wa whose one edge contacts the front substrate 101, and a portion Wb whose one edge contacts the front substrate 101 and the other edge contacts the rear substrate 111. In this case, the adhesive strength between the front substrate 101 and the rear substrate 111 can be further improved.

In FIG. 4, the portion Wa overlaps the lower dielectric layer 115, but does not overlap the upper dielectric layer 104. However, the portion Wa may overlap the upper dielectric layer 104, and may not overlap the lower dielectric layer 115.

When a first direction is parallel to a traveling direction of the seal layer 400 and a second direction crosses the first direction, a length L1 of the first portion W1 in the second direction (i.e., a section length of the first portion W1) may be longer than a length L2 of the second portion W2 in the second direction (i.e., a section length of the second portion W2).

FIGS. 5A to 5E are diagrams for explaining lengths of a first portion and a second portion.

Figure 5A:
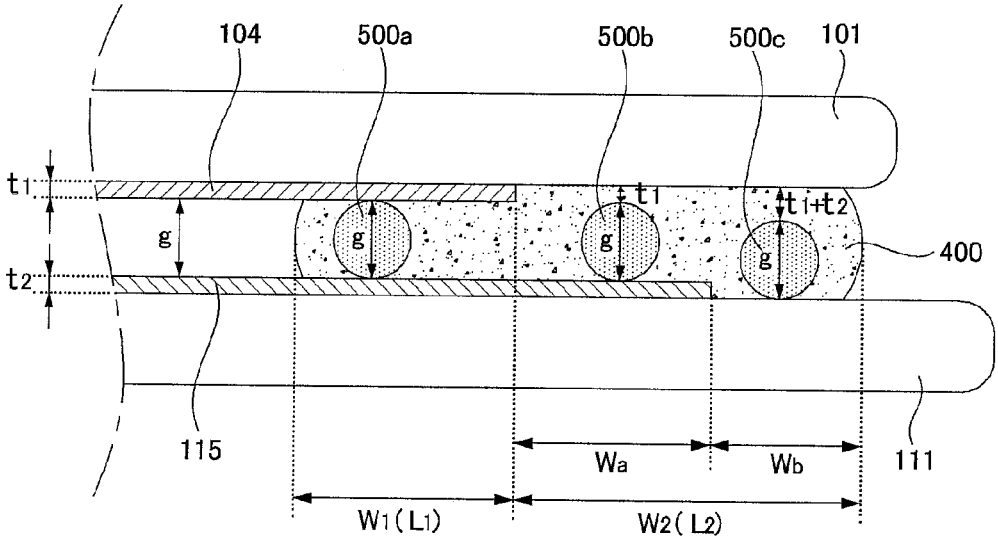
FIGS. 5A to 5E are diagrams for explaining lengths of a first portion and a second portion.

As shown in FIG. 5A, the seal layer 400 between the front substrate 101 and the rear substrate 111 includes the first portion W1 and the second portion W2, the second portion W2 includes the portion Wa and the portion Wb, the first portion W1 includes a first bead 500*a*, the portion Wa includes a second bead 500*b*, and the portion Wb includes a third bead 500*c*.

A size of each of the first, second and third beads 500*a*, 500*b* and 500*c* is indicated as g, and may be substantially equal to each other. Supposing that the first, second and third beads 500*a*, 500*b* and 500*c* are not modified and the sizes g of the beads 500*a*, 500*b* and 500*c* are kept constant even if a pressure is applied to the first, second and third beads 500*a*, 500*b* and 500*c*. A thickness of the upper dielectric layer 104 is indicated as t1, and a thickness of the lower dielectric layer 115 is indicated as t2.

An interval between the front substrate 101 and the rear substrate 111 (i.e., an interval between the upper dielectric layer 104 and the lower dielectric layer 115) may be defined as the size g of the first bead 500*a*.

Supposing that a pressure is not applied to the front substrate 101 and the rear substrate 111, the second bead 500*b* may be spaced apart from the front substrate 101 at an interval t1, and the third bead 500*c* may be spaced apart from the front substrate 101 at an interval (t1+t2).

Figure 5B:
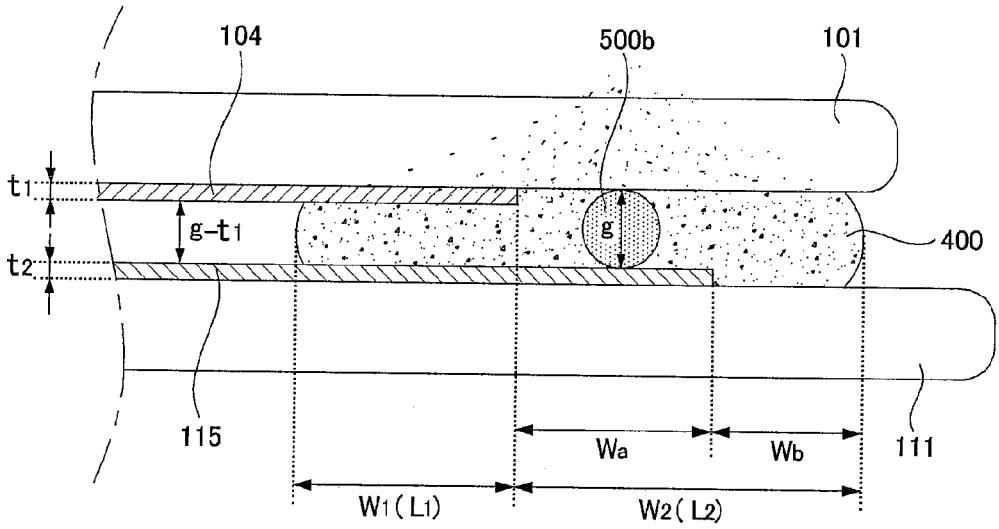

If the first portion W1 does not include the first bead 500*a*, an interval between the upper dielectric layer 104 and the lower dielectric layer 115, as shown in FIG. 5B, may be defined as a value (g−t1) through the second bead 500*b*. In this case, the front substrate 101 may collide with the barrier rib due to a vibration during the drive, and thus the generation of noise may increase.

Considering the description of FIGS. 5A and 5B, it is advantageous that the first portion W1 includes the bead. For this, it may be considered that the bead is directly inserted into the first portion W1 of the seal layer 400. However, because the seal material is mixed with the bead in a process for manufacturing the seal layer 400, it is very difficult to insert the bead into the first portion.

On the contrary, when the length L1 of the first portion W1 is longer than the length L2 of the second portion W2, it is easy to position the bead in the first portion W1.

Figure 5C:
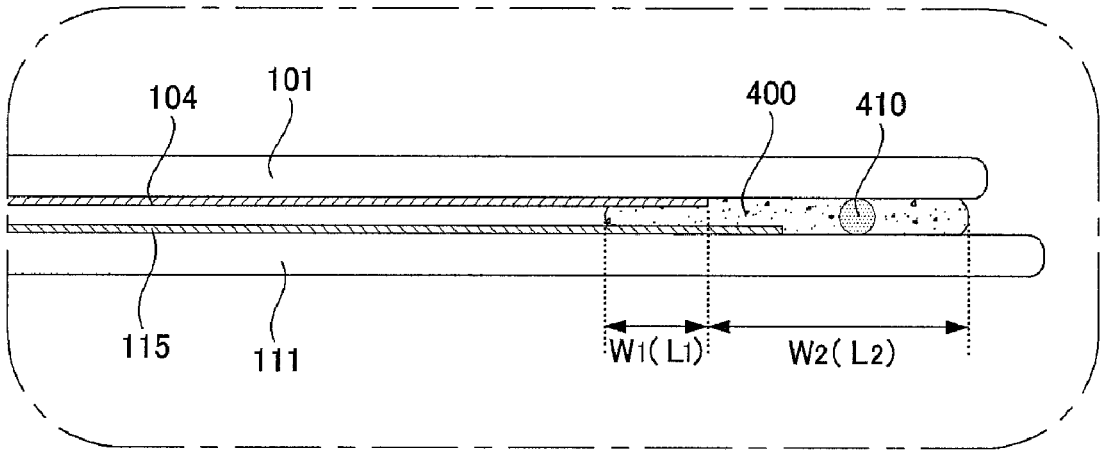

For instance, as shown in FIG. 5C, in case that the length L1 of the first portion W1 is shorter than the length L2 of the second portion W2, there is small likelihood that the first portion W1 includes the bead 410 and there is a great likelihood that the second portion W2 includes the bead 410. In this case, the generation of noise may increase.

Figure 5D:
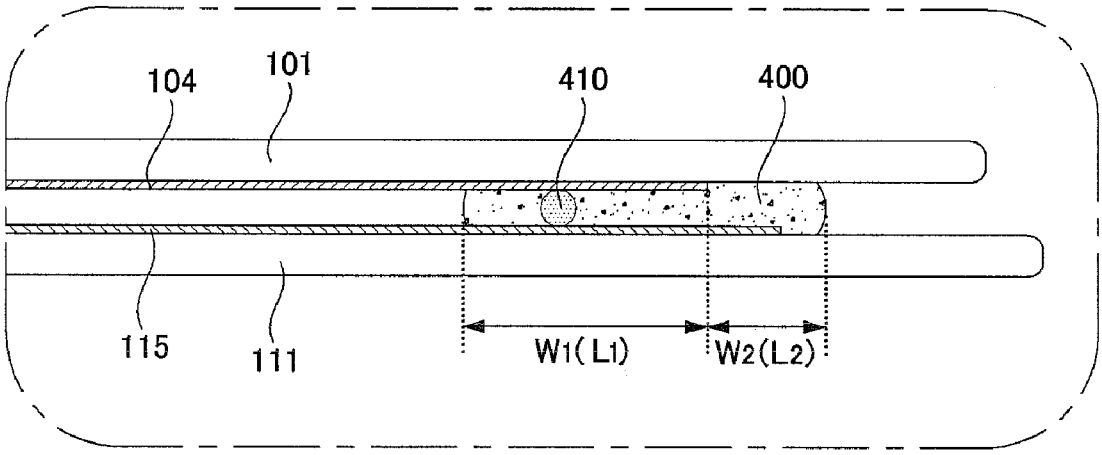

On the contrary, as shown in FIG. 5D, when the length L1 of the first portion W1 is longer than the length L2 of the second portion W2, there is a great likelihood that the first portion W1 includes the bead 410.

Accordingly, it is advantageous that the length L1 of the first portion W1 is longer than the length L2 of the second portion W2 to reduce the generation of noise.

Figure 5E:
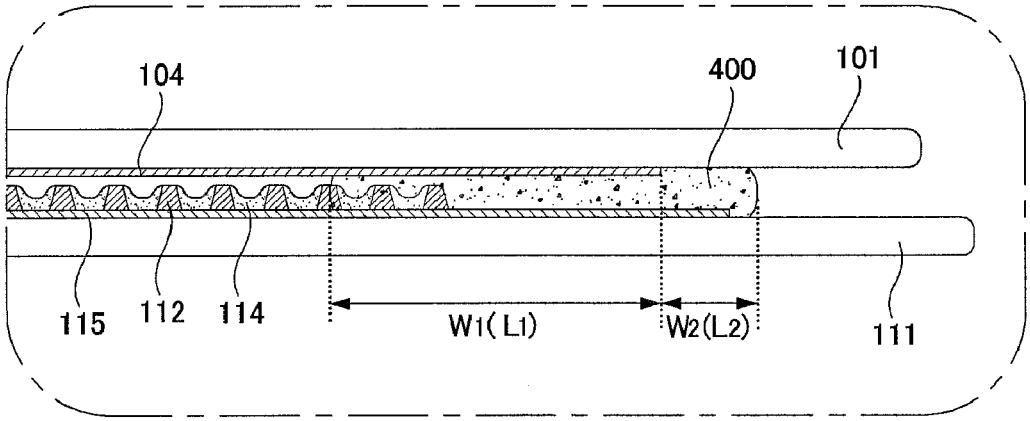

In case that the length L1 of the first portion W1 is excessively longer than the length L2 of the second portion W2, as shown in FIG. 5E, the seal layer 400 may be formed in an active area inside the discharge partitioned by the barrier rib 112. To prevent this, an interval between the seal layer 400 and the active area may be lengthened. As a result, an area where does not contribute to an image display increases, and the size of the panel may unnecessarily increase.

Considering this, the length L1 of the first portion W1 may be equal to or less than five times the length L2 of the second portion W2.

Further, the length L1 of the first portion W1 may range from 1.01 to 5 times the length L2 of the second portion W2 in consideration of an error in a manufacturing process.

Figure 6:
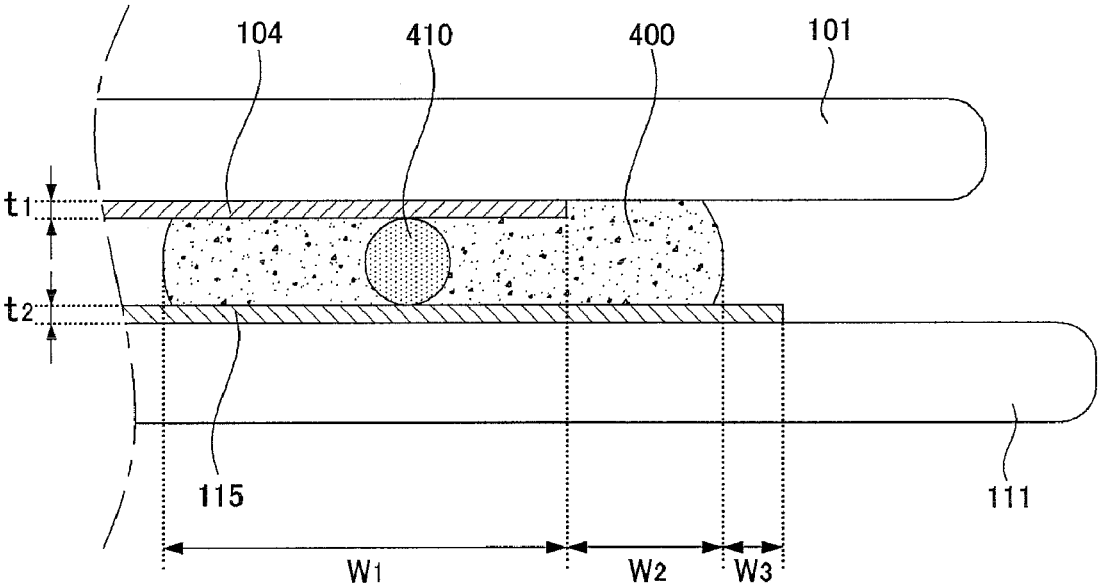
FIG. 6 illustrates another form of a seal layer.

FIG. 6 illustrates another form of a seal layer.

As shown in FIG. 6, the seal layer 400 may include the first portion W1 and the second portion W2. The second portion W2 may overlap the lower dielectric layer 115, and an edge of the second portion W2 may contact the front substrate 101. Further, the lower dielectric layer 115 may extend from an end of the second portion W2 by a length W3. It seems that the portion Wb of FIG. 4 is omitted in FIG. 6.

While the lower dielectric layer 115 extends from the end of the second portion W2 in FIG. 6, the upper dielectric layer 104 may extend from the end of the second portion W2.

Figure 7A:
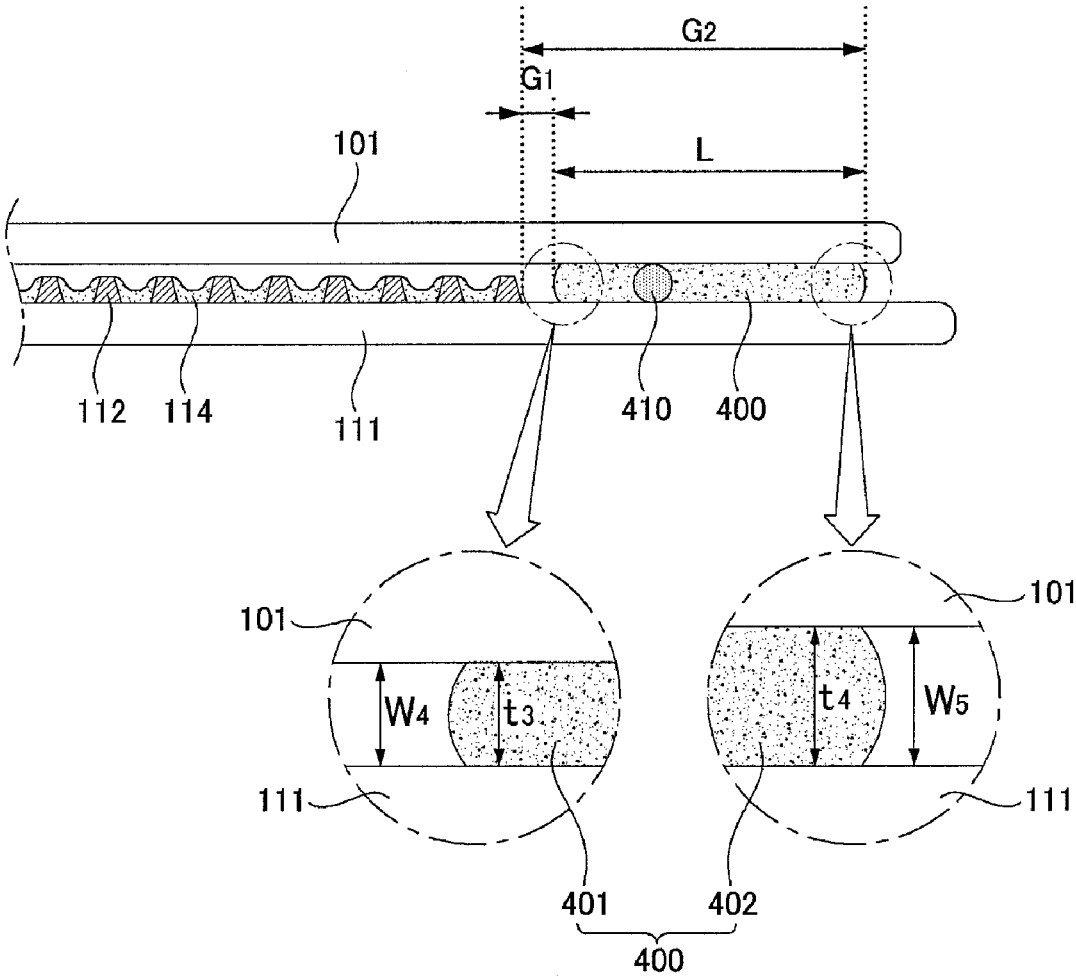
FIGS. 7A and 7B are diagrams for explaining a thickness of a seal layer.
Figure 7B:
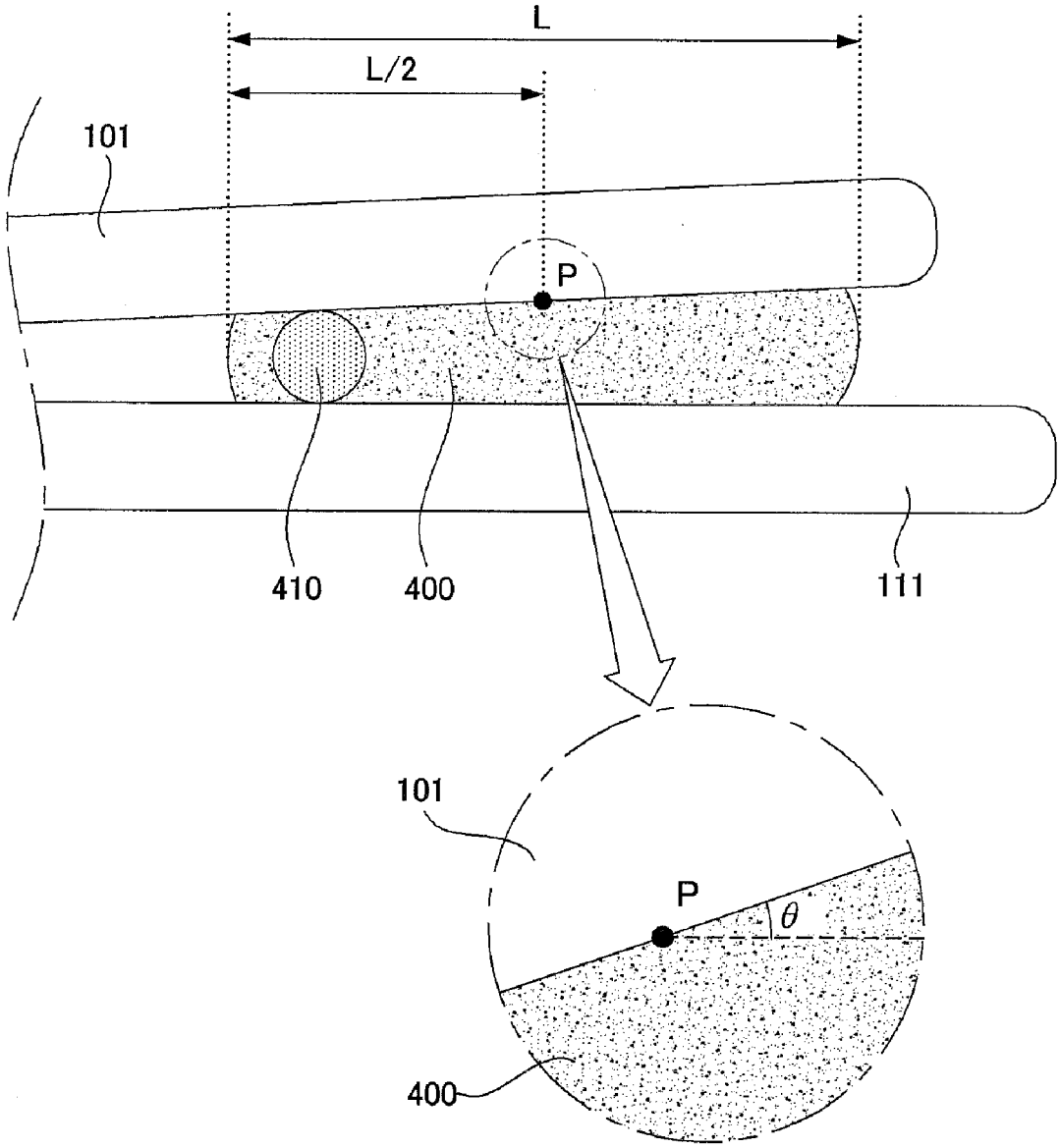

FIGS. 7A and 7B are diagrams for explaining a thickness of a seal layer.

As shown in FIG. 7A, the seal layer 400 may include a first portion 401 exposed in a direction of the barrier rib 112 and a second portion 402 exposed in an external direction of the panel. The first portion 401 may be positioned inside the panel based on the seal layer 400, and the second portion 402 may be positioned outside the panel based on the seal layer 400.

An interval between the first portion 401 and the barrier rib 112 is indicated as G1, and an interval between the second portion 402 and the barrier rib 112 is indicated as G2 longer than the interval G1.

A thickness t3 of the first portion 401 may be smaller than a thickness t4 of the second portion 402. Hence, an interval W4 between the front substrate 101 and the rear substrate 111 inside the panel based on the seal layer 400 may be smaller than an interval W5 between the front substrate 101 and the rear substrate 111 outside the panel.

As above, when the thickness t3 of the first portion 401 is smaller than the thickness t4 of the second portion 402, the front substrate 101 may bend due to the weight of the front substrate 101. Hence, the front substrate 101 and the rear substrate 111 are not positioned parallel to each other, and the front substrate 101 makes a predetermined angle with the rear substrate 111.

For instance, as shown in FIG. 7B, the front substrate 101 may make an angle of θ with the rear substrate 111 in an area between the first portion 401 and the second portion 402.

When a length of the seal layer 400 is L, the angle θ may be an angle between the front substrate 101 and the rear substrate 111 at a position corresponding to L/2 (i.e., at a middle point P of the seal layer 400).

The angle θ may be an angle in a traveling direction of the front substrate 101 based on the rear substrate 111 in a disposition area of the seal layer 400. Further, the angle θ may be an angle between the front substrate 101 and a plane parallel to the rear substrate 111 in a disposition area of the seal layer 400.

Figure 8B:
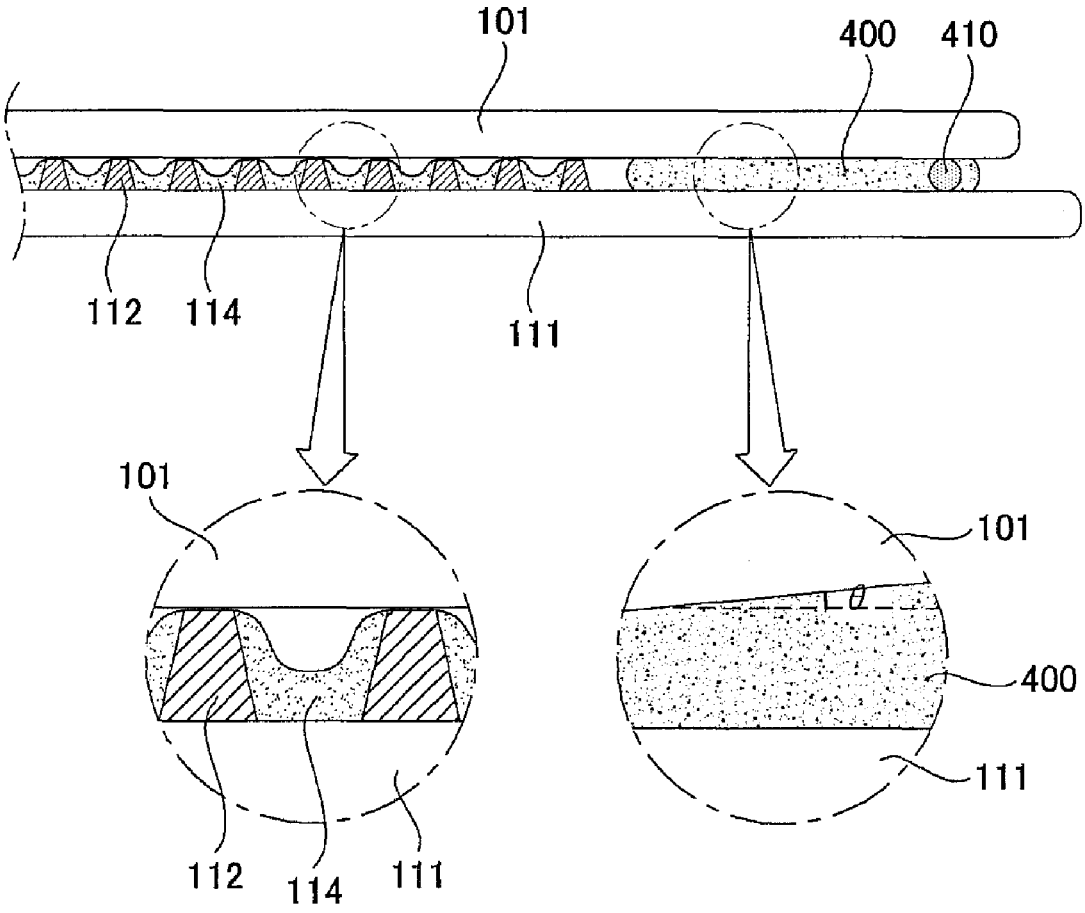
Figure 8C:
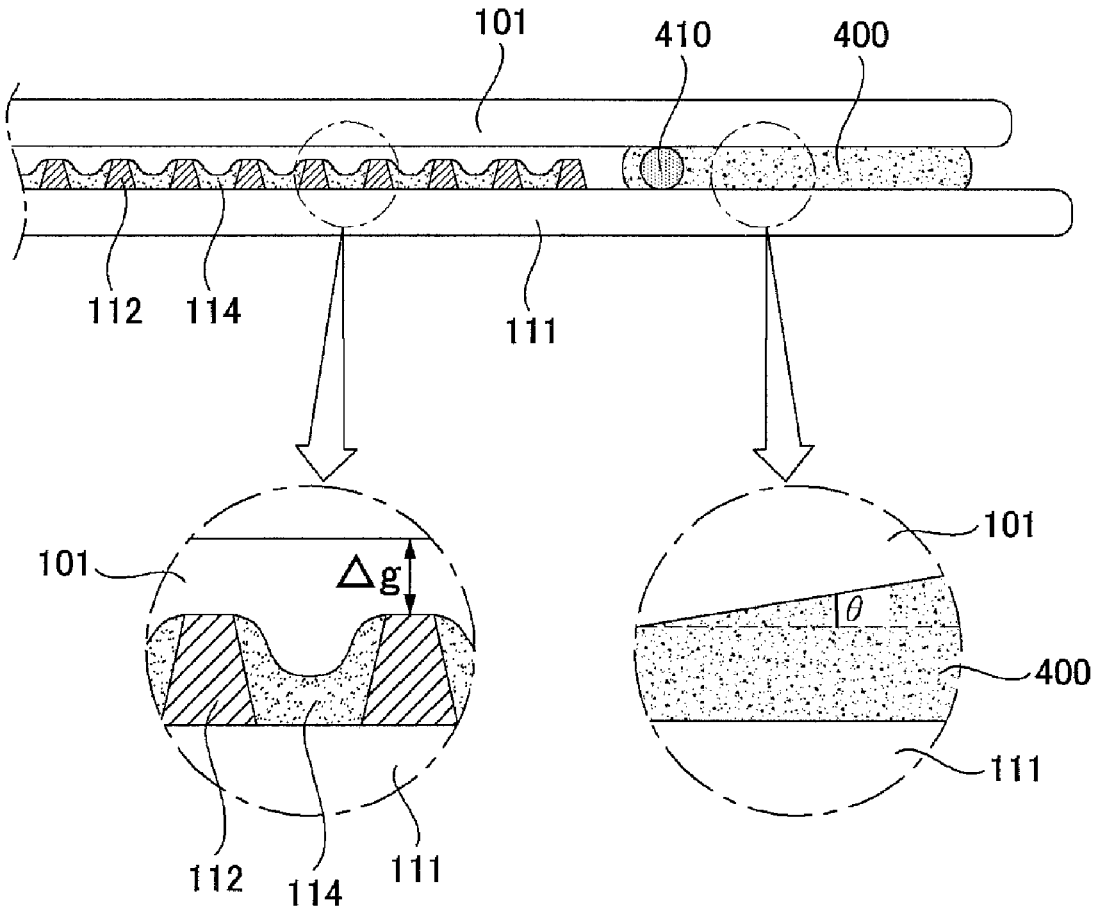

FIGS. 8A to 8C are diagrams for explaining an angle between a front substrate and a rear substrate.

FIG. 8A is a graph measuring a noise generated during the drive of the panel and observing crosstalk between the adjacent discharge cells while the angle θ between the front substrate 101 and the rear substrate 111 ranges from 0.1° to 1.3°.

A noise measuring device is disposed at 1 m of the plasma display panel ahead to measure a noise generated during the drive of the panel. While video data of a predetermined pattern is applied to the screen in a dark room, it is determined whether the crosstalk occurs or not by observing the number of discharge cells where a discharge occurs in a state where a data signal is not supplied, through a sensory test. The fact that the number of discharge cells to which the data signal is not supplied is many means that the generation of crosstalk worsens.

In FIG. 8A, ◎ indicates that the generation of noise and the generation of crosstalk are small and thus a state of the panel is excellent; ○ indicates that a state of the panel is good; and X indicates that the generation of noise and the generation of crosstalk are much and thus a state of the panel is bad (X).

As shown in FIG. 8A, when the angle θ ranges from 0.1° to 0.15°, the panel state is bad (X) because the generation amount of noise is relatively much.

For instance, as shown in FIG. 8B, the front substrate 101 have to be supported by the barrier rib 112 so as not to bend due to the weight of the front substrate 101 so that the angle θ between the front substrate 101 and the rear substrate 111 ranges from 0.1° to 0.15°. In this case, although the seal layer 400 includes the bead 410, the front substrate 101 frequently collides with the barrier rib 112 during the drive of the panel and thus the generation amount of noise may sharply increase.

When the angle θ ranges from 0.2° to 0.25°, the panel state is good (○) because the generation amount of noise decreases.

When the angle θ is equal to or larger than 0.3°, an interval between the front substrate 101 and the rear substrate 111 can be sufficiently secured. Therefore, the collision of the front substrate 101 and the rear substrate 111 can be prevented and the generation of noise can be prevented. Hence, the panel state is excellent (◎).

When the angle θ ranges from 0.1° to 0.64°, the charge transfer between the adjacent discharge cells can be prevented because an interval between the front substrate 101 and the rear substrate 111 is sufficiently small. Hence, the generation of crosstalk decreases and the panel state is excellent (◎).

When the angle θ ranges from 0.72° to 1.0°, the generation of crosstalk decreases and the panel state is good (○).

When the angle θ is equal to or larger than 1.2°, the generation of crosstalk increases and the panel state is bad (X).

For instance, as shown in FIG. 8C, a middle portion of the front substrate 101 has to sufficiently bend in a state where an edge of the front substrate 101 is supported by the bead 410 so that the angle θ is equal to or larger than 1.2°. Further, an interval Δg between the front substrate 101 and the barrier rib 112 has to lengthen. Hence, the charge transfer between the adjacent discharge cells frequently occurs, and thus the generation of crosstalk increases.

Considering the description, the angle θ between the front substrate 101 and the rear substrate 111 in the area between the first portion 401 and the second portion 402 of the seal layer 400 may range from 0.2° to 1.0°. Further, the angle θ may range from 0.3° to 0.64°.

Figure 9:
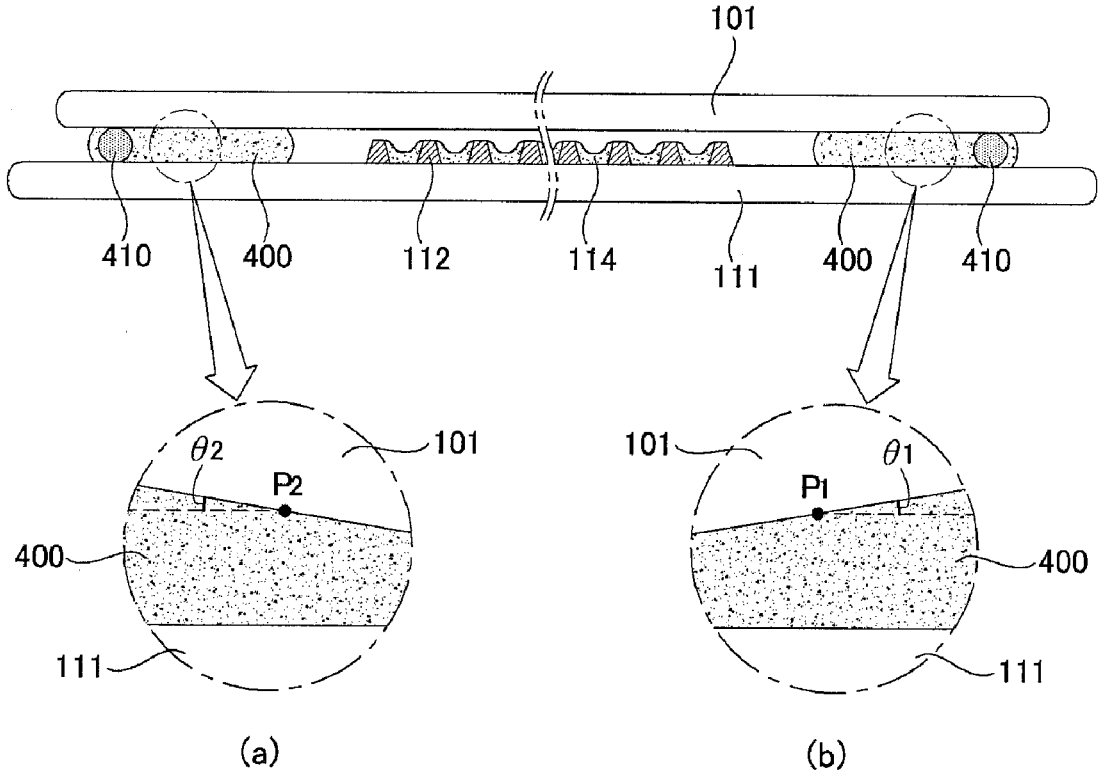
FIG. 9 is a diagram for explaining a bend of a front substrate.

FIG. 9 is a diagram for explaining a bend of a front substrate.

As shown in FIG. 9, since an edge of the front substrate 101 is supported by the bead 410, the middle portion of the front substrate 101 bends. The front substrate 101 may have a concave shape.

The front substrate 101 may make an angle of θ2 with the rear substrate 111 at a middle point P2 of the seal layer 400 on the left end of FIG. 9, as shown in (a) of FIG. 9. The front substrate 101 may make an angle of θ1 with the rear substrate 111 at a middle point P1 of the seal layer 400 on the right end of FIG. 9, as shown in (b) of FIG. 9. The angles θ1 and θ2 may be substantially equal to each other, or different from each other.

Figure 10A:
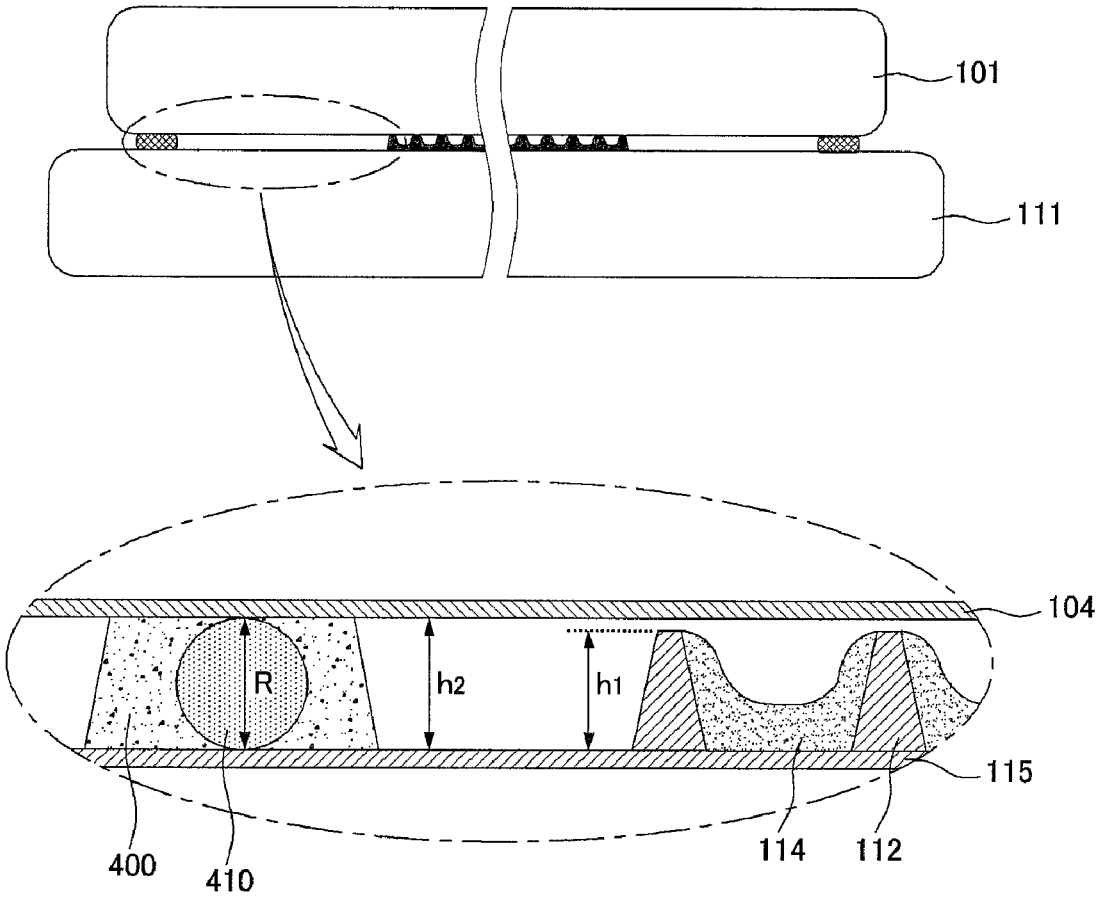
FIGS. 10A to 10C are diagrams for explaining a height of a seal layer and a size of a bead.
Figure 10B:
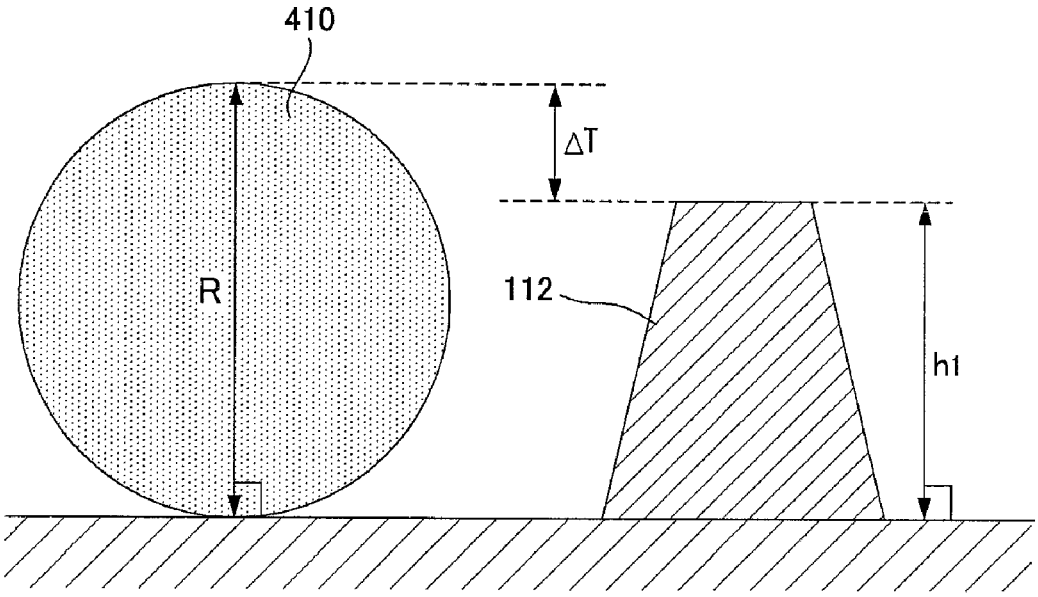
Figure 10C:
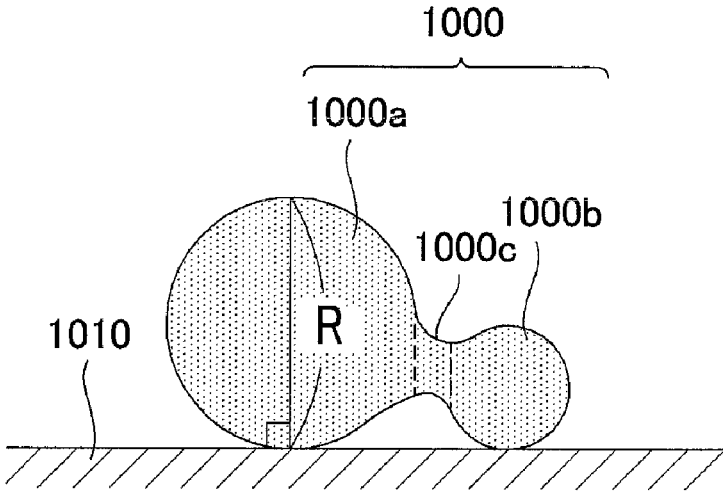

FIGS. 10A to 10C are diagrams for explaining a height of a seal layer and a size of a bead.

As shown in FIGS. 10A to 10C, the seal layer 400 is positioned between the front substrate 101 and the rear substrate 111 at edges of the substrates 101 and 111 to attach the front substrate 101 to the rear substrate 111. A height h2 of the seal layer 400 may be larger than a height h1 of the barrier rib 112. Therefore, the barrier rib 112 does not contact the upper dielectric layer 104, and is spaced apart from the upper dielectric layer 104 at a predetermined distance.

The bead 410 of the seal layer 400 properly maintains an interval between the front substrate 101 and the rear substrate 111. Therefore, the interval between the front substrate 101 and the rear substrate 111 may be determined by a size of the bead 410. For instance, supposing that a size R of the bead 410 is 200 μm, the interval between the front substrate 101 and the rear substrate 111 may be equal to or larger than 200 μm.

The size R of the bead 410, as shown in FIG. 10B, may be larger than the height h1 of the barrier rib 112 by a magnitude of ΔT so that the height h2 of the seal layer 400 is larger than the height h1 of the barrier rib 112.

If a thickness of the protective layer (not shown) is neglected in FIG. 10A, an interval between the upper dielectric layer 104 and the lower dielectric layer 115 may be substantially equal to a size R of the bead 410.

As shown in FIG. 10C, when a bead 1000 is placed on a horizontal surface 1010, a maximum height of the bead 1000 in a direction perpendicular to the horizontal surface 1010 may be referred to as a size R of the bead 1000.

The bead 1000 may have a form connecting two beads of the same shape or different shapes to each other. A bead (for instance, the bead 1000) having a form connecting at least two beads to each other is referred to as a double egg bead.

The double egg bead 1000 may include a head portion 100*b*, a body portion 1000*a*, and a connection portion 1000*c* whose the size is smaller than the size of the head portion 1000*b* and the body portion 1000*a*. The connection portion 1000*c* connects the head portion 1000*b* to the body portion 1001*a*. In other words, the double egg bead 1000 is a form connecting two beads (i.e., the head portion 1000*b* and the body portion 1000*a*) of the same shape or different shapes by the connection portion 1000*c*.

The double egg bead 1000 can efficiently disperse a pressure applied to the front substrate 101 and the rear substrate 111, and also can improve a support strength between the front substrate 101 and the rear substrate 111. Hence, the double egg bead 1000 can further reduce the generation of noise.

Figure 11:
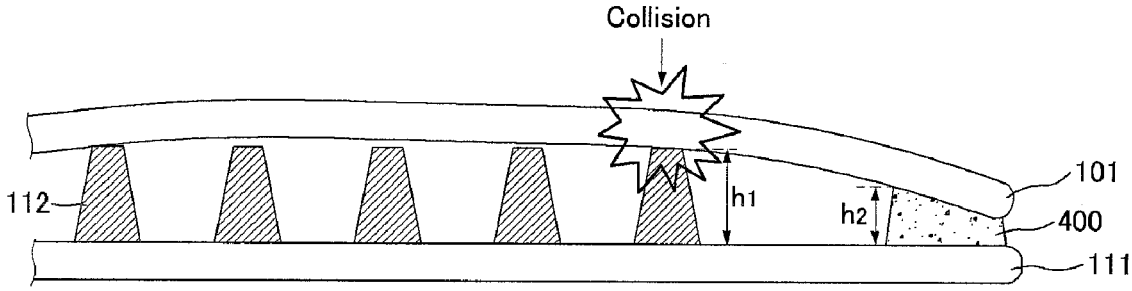
FIG. 11 is a diagram for explaining a reason why a height of a seal layer is larger than a height of a barrier rib.

FIG. 11 is a diagram for explaining a reason why a height of a seal layer is larger than a height of a barrier rib.

In FIG. 11, a height h1 of the barrier rib 112 is larger than a height h2 of the seal layer 400. In this case, although it is not shown, the size of the bead included in the seal layer 400 is smaller than the height h1 of the barrier rib 112.

Accordingly, since the height h2 of the seal layer 400 is smaller than the height h1 of the barrier rib 112 by a pressure applied by a fixing device such as a clip, the front substrate 101 may frequently collide with the barrier rib 112 during the drive of the plasma display panel. Hence, the generation of a noise may increase.

On the other hand, when as shown in FIGS. 10A and 10B, the size R of the bead 410 is higher than the height h1 of the barrier rib 112 and the height h2 of the seal layer 400 is larger than the height h1 of the barrier rib 112, the collision of the front substrate 101 and the barrier rib 112 can be prevented and the generation of noise can decrease.

Figure 12:
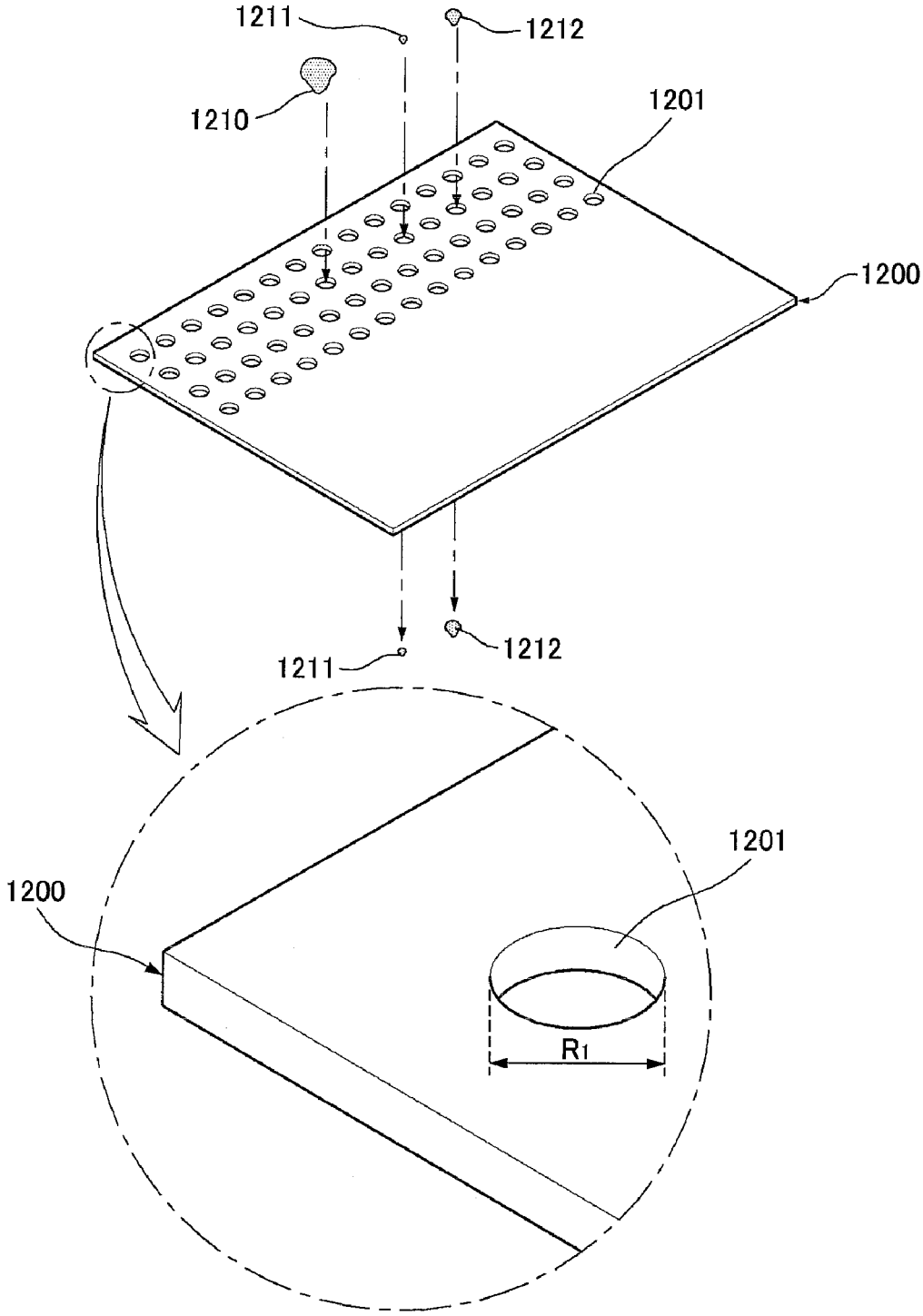
FIG. 12 is a diagram for explaining a method of manufacturing a bead.

FIG. 12 is a diagram for explaining a method of manufacturing a bead. FIGS. 13A to 13D are diagrams for explaining a shape of a bead and a location of the bead inside a seal layer.

First, as shown in FIG. 12, a filter unit 1200 including a plurality of holes 1201 performs a filtering operation on beads 1210, 1211 and 1212 manufactured through predetermined processes. A diameter of the hole 1201 may be R1.

More specifically, the beads 1210, 1211 and 1212 are placed on the filter unit 1200. Then, the beads 1211 and 1212 having a size smaller than the diameter R1 of the hole 1201 may pass through the filter unit 1200, and the bead 1210 having a size larger than the diameter R1 of the hole 1201 may not pass through the filter unit 1200.

The beads 1211 and 1212 going through the filtering process are mixed with the seal material to form the seal layer.

Figure 13A:
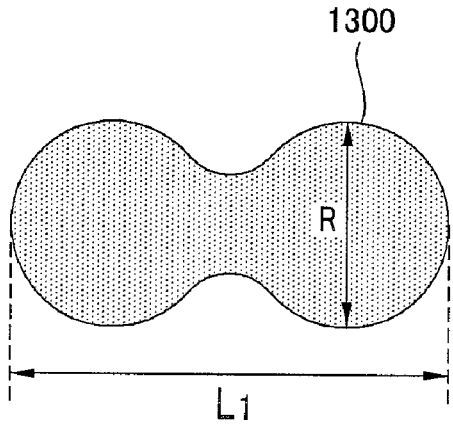
FIGS. 13A to 13D are diagrams for explaining a shape of a bead and a location of the bead inside a seal layer.

FIG. 13A shows a double egg bead 1300 having a size of R and a length of L1.

Figure 13B:
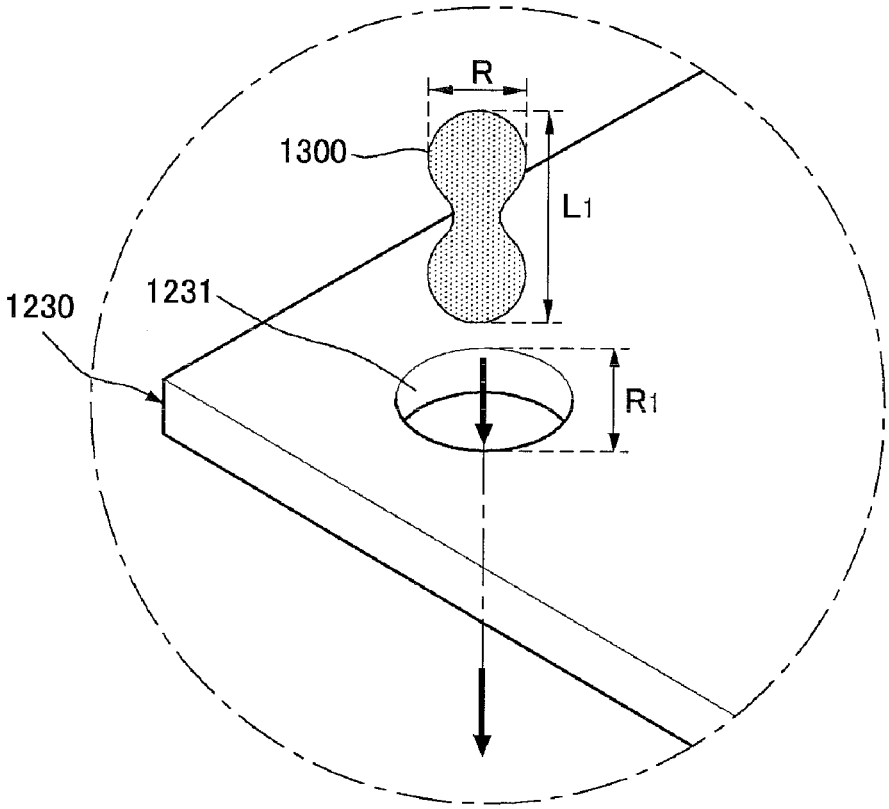

A filter unit 1230, as shown in FIG. 13B, passes the double egg bead 1300 through a hole 1231 of the filter unit 1230 in a longitudinal direction of the double egg bead 1300 to filter the double egg bead 1300. The size R of the double egg bead 1300 is smaller than a diameter R1 of the hole 1231.

Figure 13C:
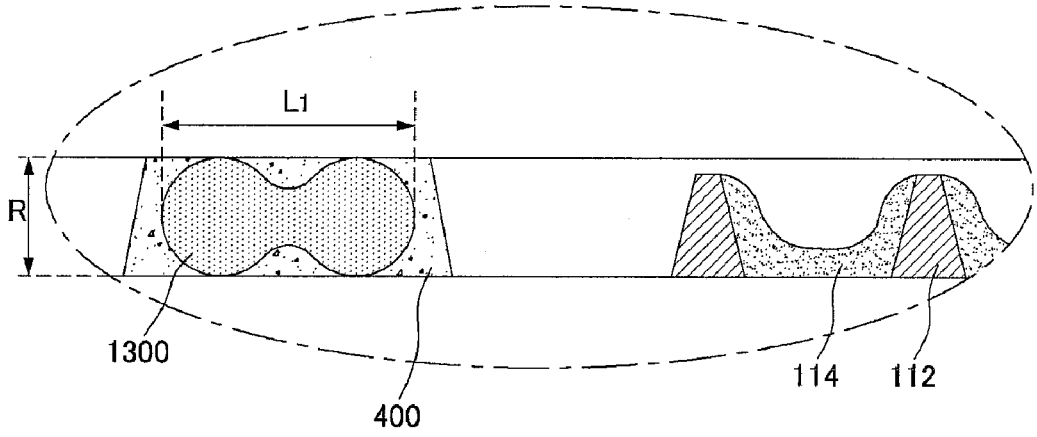

The double egg bead 1300, as shown in FIG. 13C, may be positioned inside the seal layer 400 in a transverse direction of the double egg bead 1300.

Because the fixing device applies a pressure to the front substrate and the rear substrate in the coalescing process of the front and rear substrates, the double egg bead 1300 is positioned inside the seal layer 400 in a direction capable of bearing the pressure, for instance, in the transverse direction as shown in FIG. 13C.

The size R of the double egg bead 1300 may be defined as the diameter R1 of the hole 1231 of the filter unit 1230 so as to filter the double egg bead 1300. Further, the size R of the double egg bead 1300 may be defined as a largest section length of the double egg bead 1300 in a direction perpendicular to a direction passing through the hole 1231.

Figure 13D:
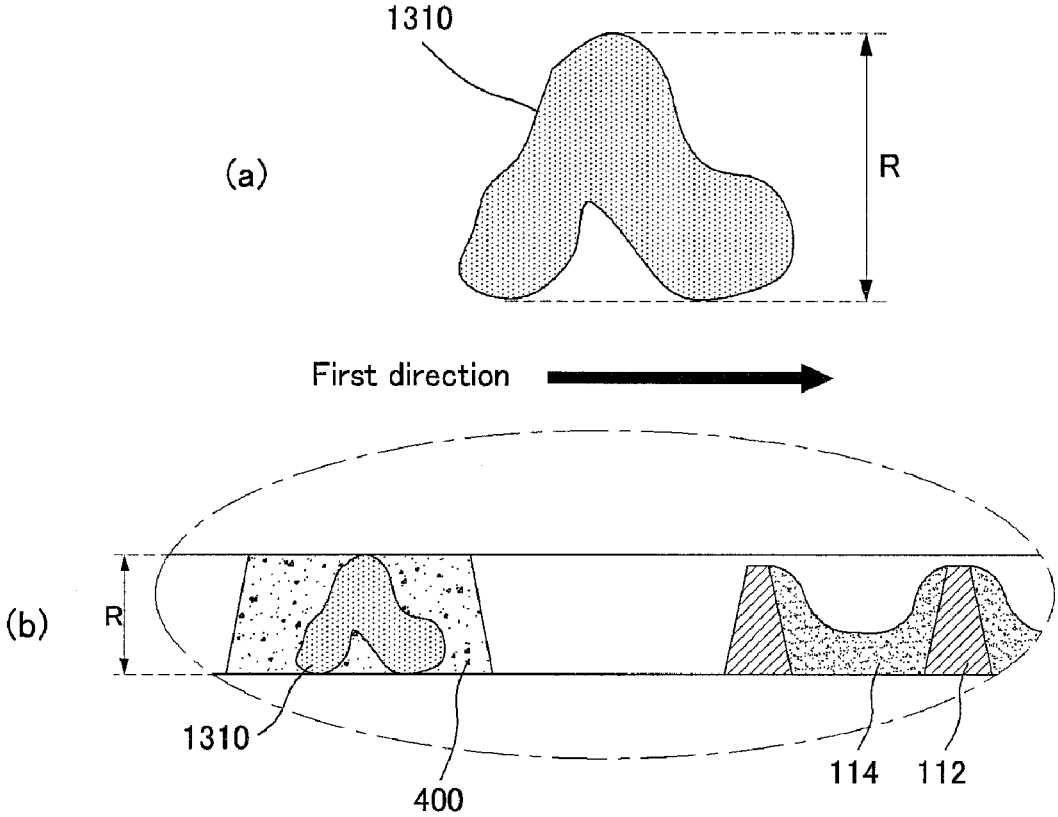

As shown in FIG. 13D, a double egg bead 1310 shown in (a) may be positioned inside the seal layer 400 in a direction capable of effectively dispersing a pressure applied to the front substrate and the rear substrate. For instance, the double egg bead 1310 may be positioned as shown in (b) of FIG. 13D.

The double egg bead 1310 may pass through the hole 1201 of FIG. 12 in a first direction, and also may be positioned inside the seal layer 400 in a direction parallel to the first direction.

A size R of the double egg bead 131 may be defined as a length of the double egg bead 1310 in a direction perpendicular to the first direction.

Figures 14A, 14B:
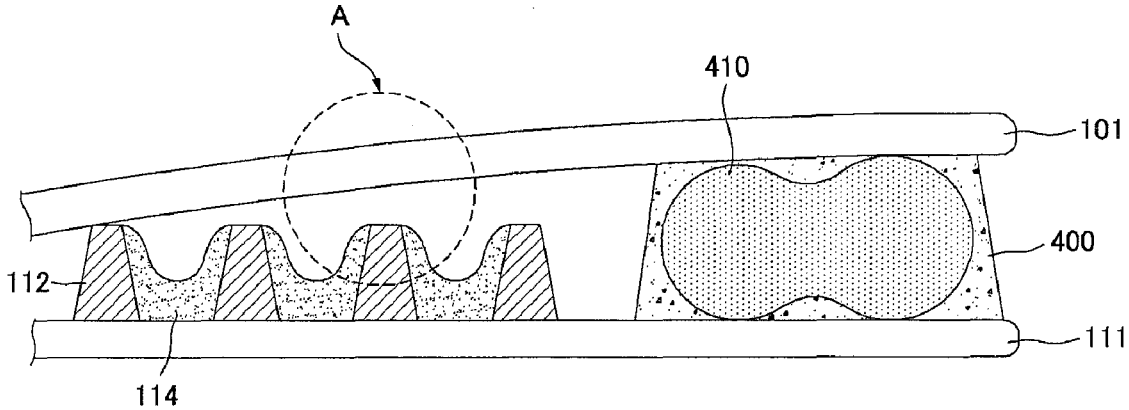
FIGS. 14A to 14C are diagrams for explaining a relationship between a size of a bead and a height of a barrier rib.
Figure 14C:
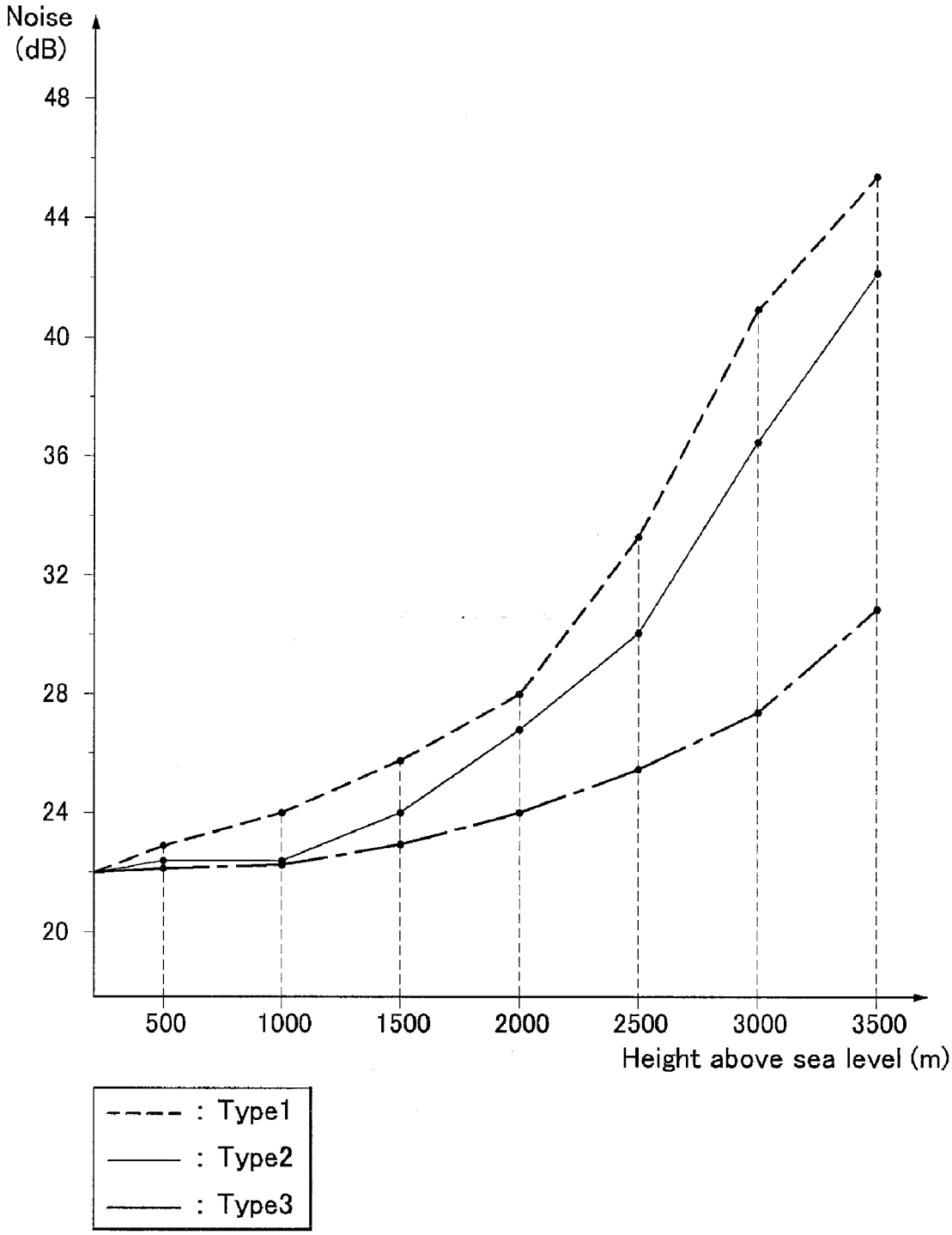

FIGS. 14A to 14C are diagrams for explaining a relationship between a size of a bead and a height of a barrier rib.

In FIGS. 14A to 14C, when a height h of the barrier rib 112 is 125 μm and a ratio R/h of the size R of the bead to the height h of the barrier rib 112 ranges from 0.9 to 1.8, a noise generated during the drive of the plasma display panel is measured and the generation of crosstalk between the adjacent discharge cells is observed.

The noise is measured on condition that a noise measuring device is disposed at 1 m of the plasma display panel ahead and the same video data is supplied to the plasma display panel. While video data of a predetermined pattern is applied to the screen in a dark room, it is determined whether the crosstalk occurs or not by observing the number of discharge cells where a discharge occurs in a state where a data signal is not supplied, through a sensory test. The fact that the number of discharge cells to which the data signal is not supplied is many means that the generation of crosstalk worsens. Supposing that the size R of the bead is substantially equal to a height of the seal layer.

As shown in FIG. 14A, when the ratio R/h ranges from 0.9 to 0.95, the front substrate may contact the barrier rib because the size R of the bead is smaller as compared with the height h of the barrier rib. Therefore, the noise may increase due to the frequent collision of the front substrate and the barrier rib during the drive, and thus a panel state is bad (X).

When the ratio R/h is 1.01, the collision of the front substrate and the barrier rib can be prevented because the size R of the bead is proper. Accordingly, the generation of noise may decrease, and thus the panel state is good (○). In this case, although the noise occurs, the generation amount of noise may be small.

When the ratio R/h is equal to or more than 1.04, the size R of the bead is large as compared with the height h of the barrier rib and an interval between the barrier rib and the front substrate can be sufficiently secured. Since the collision of the front substrate and the barrier rib can be prevented even if a vibration occurs during the drive, the generation of noise can be efficiently prevented and the panel state is excellent (◎).

When the ratio R/h is 0.9, a path of charge transfer between the adjacent discharge cells cannot be provided because the front substrate may contact the barrier rib. Accordingly, because the generation of crosstalk due to the charge transfer between the adjacent discharge cells can be reduced, the panel state is good (○). In this case, since a middle portion of the front substrate may be more convex than an edge portion thereof, a path of the charge transfer between the adjacent discharge cells may be provided. However, although the crosstalk occurs, the generation amount of crosstalk may be small.

When the ratio R/h is 1.45, the front substrate is spaced apart from the barrier rib at a proper distance therebetween, and thus the generation of crosstalk is reduced. Although the charge transfer between the adjacent discharge cells occurs, the generation amount of crosstalk may be small.

When the ratio R/h ranges from 0.95 to 1.37, the front substrate is spaced apart from the barrier rib at a sufficiently small interval therebetween so as to prevent the crosstalk between the adjacent discharge cells. Accordingly, the crosstalk may decrease and the panel state is excellent (◎).

When the ratio R/h is equal to or more than 1.7, as shown in FIG. 14B, the height of the seal layer 400 may be excessively higher than the height h of the barrier rib 112. An interval between the front substrate 101 and the barrier rib 112, as sown in an area A of FIG. 14B, may excessively widen. Therefore, the crosstalk may increase and the panel state is bad (X).

FIG. 14C is a graph showing a relationship between a height above sea level and a noise.

A 1-typed plasma display panel indicates a case where the seal layer does not a bead; a 2-typed plasma display panel indicates a case where a ratio R/h of the size R of the bead to the height h of the barrier rib is 1.0 (i.e., the size R of the bead is substantially equal to the height h of the barrier rib); and a 3-typed plasma display panel indicates a case where a ratio R/h of the size R of the bead to the height h of the barrier rib is 1.1.

When the 1-, 2- and 3-typed plasma display panels are driven at 0 m, 500 m, 1,000 m, 1,500 m, 2,000 m, 2,500 m, 3,000 m, and 3,500 m above sea level, a noise is measured.

The amount of noise is calculated by measuring the noise at each frequency of 0.5 kHz, 1 kHz, 2 kHz, 4 kHz, 8 kHz and 16 kHz and then adding the noises measured at the frequencies. The other experimental conditions are the same as those of FIGS. 14A to 14C.

The 1-, 2- and 3-typed plasma display panels may have a noise of about 22 dB at 0 m above sea level.

The 1-typed plasma display panel may have a noise of about 22.7 dB, about 24 dB, about 25.8 dB, about 28 dB, about 33.4 dB, about 40.9 dB and about 45.5 dB at 500 m, 1,000 m, 1,500 m, 2,000 m, 2,500 m, 3,000 m, and 3,500 m above sea level, respectively.

In the 1-typed plasma display panel not including the bead, as the height above sea level rises from 0 m to 3,500 m, the noise rises from 22 dB to 45.5 dB.

As the height above sea level rises, an internal pressure of the plasma display panel is higher than an external air pressure of the panel. Hence, a small interval is provided between the front substrate and the barrier rib, and the front substrate frequently collides with the barrier rib due to a vibration during the drive, thereby greatly generating the noise. For instance, the noise may occur due to the collision of the protective layer on the front substrate and the barrier rib on the rear substrate.

The 2-typed plasma display panel may have a noise of about 22.3 dB, about 22.3 dB, about 24 dB, about 26.7 dB, about 30.1 dB, about 36.5 dB and about 42.2 dB at 500 m, 1,000 m, 1,500 m, 2,000 m, 2,500 m, 3,000 m, and 3,500 m above sea level, respectively.

In the 2-typed plasma display panel, as the height above sea level rises from 0 m to 3,500 m, the noise rises from 22 dB to 42.2 dB.

The 3-typed plasma display panel may have a noise of about 22.1 dB, about 22.2 dB, about 23.1 dB, about 24 dB, about 25.8 dB, about 27.5 dB and about 30.6 dB at 500 m, 1,000 m, 1,500 m, 2,000 m, 2,500 m, 3,000 m, and 3,500 m above sea level, respectively.

In the 3-typed plasma display panel, as the height above sea level rises from 0 m to 3,500 m, the noise rises from 22 dB to 30.6 dB.

Considering the description of FIGS. 14A to 14C, the ratio R/h may range from 1.01 to 1.45. Further, the ratio R/h may range from 1.04 to 1.37.

The noise associated with the height above sea level in FIG. 14C can be reduced by adjusting a pressure of the discharge gas of the plasma display panel.

For instance, in cast that a gas pressure inside the panel is excessively high (i.e., an internal pressure of the panel is higher than an external air pressure of the panel), the front substrate may frequently collide with the barrier rib during the drive. Hence, the generation of noise may increase. In this case, even if the height above sea level is slightly higher, the generation amount of noise may sharply increase.

On the contrary, in case that the gas pressure inside the panel is excessively low, the number of particles of the discharge gas may decrease. Hence, the amount of ultraviolet rays generated by the discharge gas during the drive may decrease, and a luminance of an image may be reduced. Accordingly, a pressure of the discharge gas may be 350 torr to 450 torr.

Figure 15:
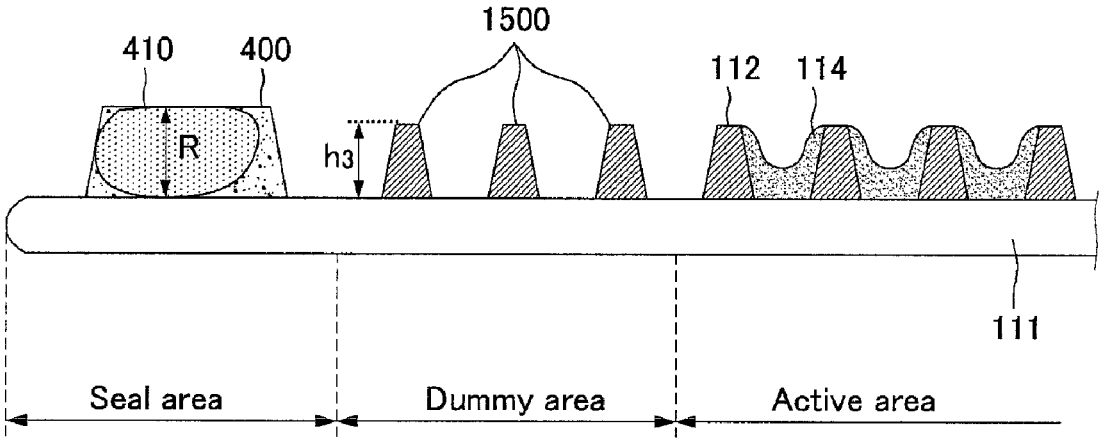
FIG. 15 is a diagram for explaining a dummy barrier rib.

FIG. 15 is a diagram for explaining a dummy barrier rib.

As shown in FIG. 15, the plasma display panel may include an active area where the discharge cell partitioned by the barrier rib 112 is positioned, a dummy area where a dummy barrier rib 1500 is positioned, and a seal area where the seal layer 400 is positioned.

The dummy area may be positioned outside the active area, and the seal area may be positioned outside the dummy area. The dummy barrier rib 1500 may be positioned between the seal layer in the seal area and the barrier rib 112 in the active area.

The phosphor layer 114 may be positioned inside the discharge cell of the active area. A dummy discharge cell may be partitioned by the dummy barrier rib 1500 in the dummy area. The phosphor layer 114 may or may not be positioned inside the dummy discharge cell.

A height h3 of the dummy barrier rib 1500 may be smaller than the height of the seal layer 400. The height h3 of the dummy barrier rib 1500 may be smaller than the size R of the bead 410 included in the seal layer 400. Accordingly, the generation of noise can be reduced.

Figure 16:
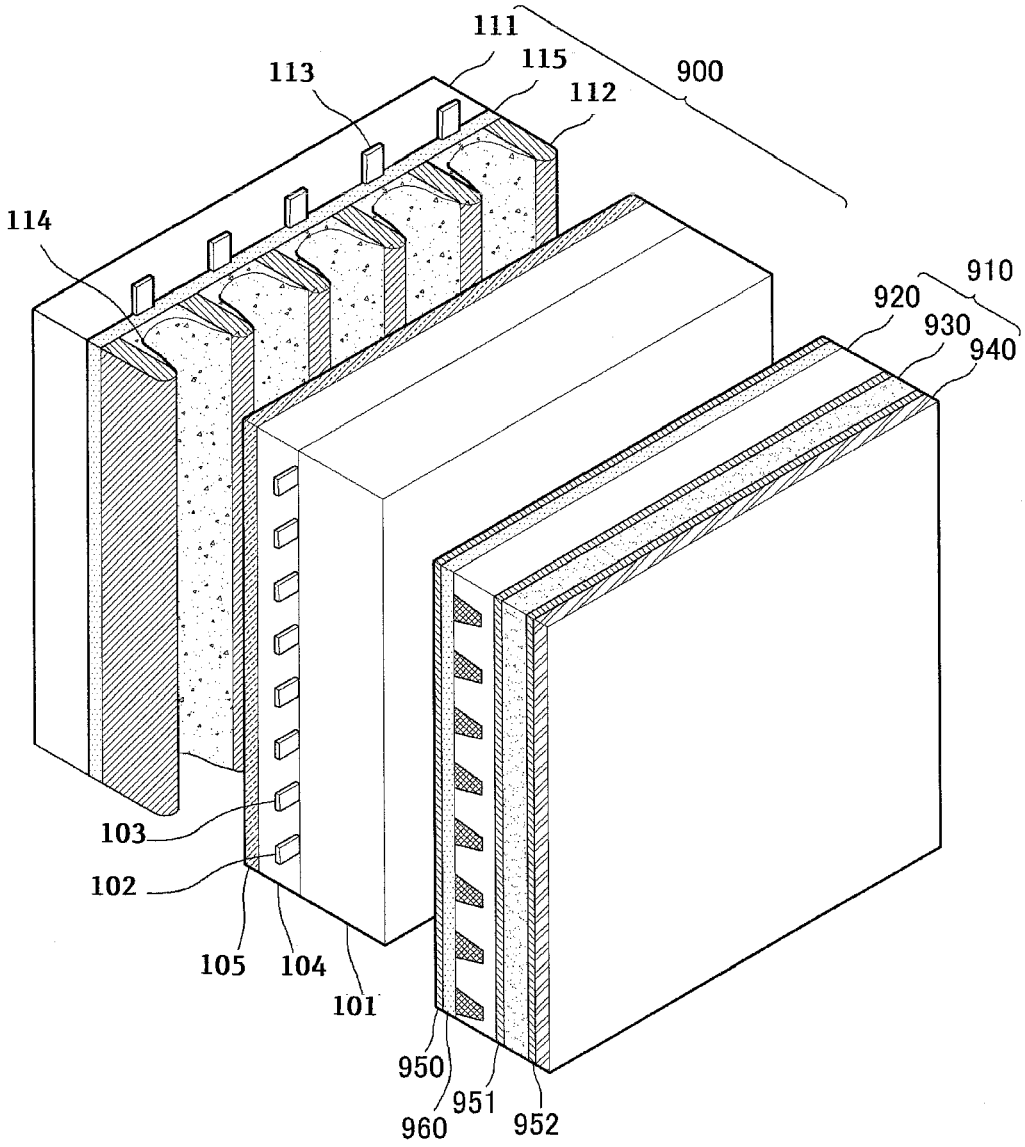
FIG. 16 illustrates an example of a plasma display apparatus according to the exemplary embodiment.

FIG. 16 illustrates an example of a plasma display apparatus according to the exemplary embodiment.

As shown in FIG. 16, the plasma display apparatus according to the exemplary embodiment includes a plasma display panel 900 displaying an image and a display filter 910. The plasma display panel 900 was described in detail through FIGS. 1 to 15.

The display filter 910 may include a shielding layer 920 for shielding light coming from the outside. The display filter 910 may further include a color layer 930 and an electromagnetic interference (EMI) shielding layer 940.

A second adhesive layer 951 may be positioned between the shielding layer 920 and the color layer 930 to attach the shielding layer 920 to the color layer 930. A third adhesive layer 952 may be positioned between the color layer 930 and the EMI shielding layer 940 to attach the color layer 930 to the EMI shielding layer 940.

A reference numeral 960 indicates a substrate. The substrate 960 provides a space capable of forming the shielding layer 920, the color layer 930 and the EMI shielding layer 940. The substrate 960 may be formed of a polymer resin.

The display filter 910 may further include a near infrared shielding layer.

Locations of the shielding layer 920, the color layer 930, the EMI shielding layer 940 and the substrate 960 may change. For instance, the EMI shielding layer 940 may be positioned on the substrate 960, the color layer 930 may be positioned on the EMI shielding layer 940, and the shielding layer 920 may be positioned on the color layer 930.

The display filter 910 may be positioned in front of the plasma display panel 900. The display filter 910 may be a film filter. For instance, the display filter 910 may include a first adhesive layer 950, and the display filter 910 may be attached to a front surface of the plasma display panel 900 using the first adhesive layer 950.

A reason why the display filter 910 is a film filter will be described below.

The display filter 910 may be mainly classified into a glass filter and a film filter.

The glass filter has a structure in which at least one functional layer is staked on a glass substrate that is a basic layer. The glass filter may be spaced apart from the front surface of the plasma display panel at a predetermined distance.

The film filter is more inexpensive than the glass filter, and can be easily attached to the front surface of the plasma display panel through a lamination method. A structure for holding and supporting the glass filter is necessary to position the glass filter in front of the plasma display panel, thereby increasing the manufacturing cost of the glass filter.

Because the glass substrate is the basic substrate in the glass filter, the glass filter can prevent a noise generated in the plasma display panel during the drive from being discharged to the outside to some extent.

On the other hand, because the film filter is based on the substrate formed of, e.g., the polymer resin, a prevention level of a noise generated in the plasma display panel during the drive in the film filter is lower than a prevention level of the noise in the glass filter. The film filter may cause the problem of noise.

When a seal layer used to attach the front and rear substrates of the plasma display panel includes beads and a size of the bead is larger than a height of the barrier rib, the generation of noise can be reduced.

Because the plasma display panel according to the exemplary embodiment includes the beads, the generation of noise can be reduced.

Although the film filter positioned in front of the plasma display panel including the beads does not prevent a noise generated in the plasma display panel during the drive, the noise problem can be solved and the manufacturing cost can be reduced.

Accordingly, since the plasma display panel according to the exemplary embodiment includes the seal layer including the beads and the film filter as a display filter, a reduction in the manufacturing cost as well as the prevention of noise can be achieved.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art.

What is claimed is:

1. A plasma display panel, comprising:

a front substrate on which an upper dielectric layer is positioned;

a rear substrate on which a lower dielectric layer is positioned, the rear substrate being positioned opposite the front substrate;

a barrier rib positioned between the front substrate and the rear substrate; and a seal layer positioned between the front substrate and the rear substrate, the seal layer including:

a double egg bead;

a first portion positioned in an overlap area of the upper dielectric layer and the lower dielectric layer;

a second portion positioned in an area where at least one of the upper dielectric layer or the lower dielectric layer is omitted; and a third portion positioned in an area where both the upper dielectric layer and the lower dielectric layer are omitted, a length of the first portion being longer than a total length of the second portion and the third portion, wherein the double egg bead includes a head portion, a body portion and a connection portion, and wherein a size of the connection portion is less than a size of the head portion and the body portion.

2. The plasma display panel of claim 1, wherein a thickness of the seal layer is larger than a height of the barrier rib.

3. The plasma display panel of claim 1, wherein a size of the double egg bead is larger than a height of the barrier rib.

4. The plasma display panel of claim 1, wherein a ratio of a size of the double egg bead to a height of the barrier rib ranges from 1.01 to 1.45.

5. The plasma display panel of claim 1, wherein a size of the double egg bead is substantially equal to an interval between the upper dielectric layer on the front substrate and the lower dielectric layer on the rear substrate.

* * * * *